US006183159B1

(12) United States Patent
Hashimoto et al.

(10) Patent No.: US 6,183,159 B1
(45) Date of Patent: Feb. 6, 2001

(54) AUTOMOTIVE SOIL TREATING MACHINE

(75) Inventors: Hisayoshi Hashimoto, Ushiku; Fujio Sato, Tsukuba; Yasuharu Yamamoto, Nishio; Toshikazu Murai, Chiyoda-machi; Tetsushiro Miura, Yokohama; Fumiki Nakagiri, Odawara; Takami Kusaki, Chiyoda; Satoshi Sekino, Ryugasaki; Kiyonobu Hirose, Ushiku; Yoshio Mizuno, Ena; Nobuo Ito, Aichi-ken; Hideki Fukuzawa, Nagoya, all of (JP)

(73) Assignee: Hitachi Construction Machinery Co., Ltd., Tokyo (JP)

( * ) Notice: Under 35 U.S.C. 154(b), the term of this patent shall be extended for 0 days.

(21) Appl. No.: 09/358,417

(22) Filed: Jul. 22, 1999

(30) Foreign Application Priority Data

Jul. 24, 1998 (JP) ..... 10-209647
Feb. 12, 1999 (JP) ..... 11-034387

(51) Int. Cl.[7] ..... E01C 23/08; E01C 23/12
(52) U.S. Cl. ..... 404/76; 404/90; 404/91; 404/92
(58) Field of Search ..... 404/76, 83, 90, 404/91, 92; 241/101.74

(56) References Cited

U.S. PATENT DOCUMENTS 5,460,332 * 10/1995 Frick ..... 241/101.74
5,803,376 * 9/1998 Koyanagi et al. ..... 241/36
5,988,937 * 11/1999 Komoriya et al. ..... 404/90
6,000,641 * 12/1999 Komoriya et al. ..... 241/29

FOREIGN PATENT DOCUMENTS 56-28948 * 3/1981 (JP) .
59-229570 * 12/1984 (JP) .
08206537A * 8/1996 (JP) .
WO97/25485 * 7/1997 (WO) .
WO97/25486 * 7/1997 (WO) .

* cited by examiner

*Primary Examiner*—Eileen D. Lillis
*Assistant Examiner*—Gary S. Hartmann
(74) *Attorney, Agent, or Firm*—Oblon, Spivak, McClelland, Maier & Neustadt, P.C.

(57) ABSTRACT

A vehicular automotive soil treating machine having a main frame structure provided on an automotive drive means to support thereon a soil feeding stage including at least a soil hopper and an additive hopper for feeding soil and an additive soil improving material, a soil processing stage including a soil processing trough which is internally provided with a mixing device for mixing soil and additive material while being transferred from one to the other end of the soil processing trough, and a processed soil discharging stage including a soil discharging conveyer for transferring processed soil of improved quality in a predetermined direction. The soil processing trough is provided with an inlet opening on the upper side of its fore end portion to receive soil and additive material therethrough, and an outlet opening on the bottom side of its rear end portion to discharge processed soil of improved quality toward the discharging conveyer.

25 Claims, 22 Drawing Sheets

AUTOMOTIVE SOIL TREATING MACHINE

BACKGROUND OF THE INVENTION

1. Field of the Art

This invention relates generally to a soil treating machine for use in treating soil for the purpose of strengthening foundation of a soft ground by improving soil construction or quality to suit a specific purpose of use, and more particularly to an automotive or vehicular soil treating machine which can travel on and along surfaces of a ground or terrain in the course of soil treatment therefor.

2. Prior Art

When excavating a ground, for example, for laying gas pipes, running water pipes or sewage pipes or for a road construction work or for other foundational work, it is the most desirable way to refill an excavated ground with removed soil without giving any treatment thereto. However, in some cases excavated soil is found unsuitable for refilling. In such a case, it becomes necessary to discard excavated soil and to refill the excavated ground with soil of better quality or property. For example, in some cases excavated soil contains rocks, fragments of bricks or concrete and/or metallic or other foreign material in a large amount, prohibiting to use the soil for refilling purposes. Further, refilling of weak soil, e.g., soil which is extremely small in grain size and highly viscous like clay or soil which has undergone weathering to an excessive degree to make solidification difficult, could result in sinking of the foundation of the refilled ground. Further, in case soil occurring in a ground excavation work is of extremely inferior quality, it has to be discarded as industrial waste despite strict legal regulations on waste of this sort. Therefore, there have been strong demands for means of soil treatment which can convert soil of substandard quality into useful resources.

In this connection, in the case of soil which simply contains foreign matter in a mixed state, it can be refilled into an excavated ground after sieving out the foreign matter. On the other hand, in the case of soil which is so soft and weak as would invite sinking of the foundation if used as a refill, it has to be treating with a soil improving or strengthening agent or material before refilling. In a soil treatment of this sort, for example, the conventional practice has been to mix lime and cement into excavated dirt and soil for solidification and to produce soil of improved construction or quality which can be suitably used for refilling an excavated ground or for other purposes.

Typical of mixing machines which have thus far been employed in soil solidification treatments for mixing a soil improving agent or material into excavated soil are mixer type machines which is equipped with a rotary mixing means and crusher type machines with rotary crusher drums. More specifically, in the case of a mixer type machine, excavated soil is uniformly mixed with a soil improving material within a tank with a mixing means. The mixing means is either a batch type having functions of agitating and mixing contents of a mixing tank or a screw type having functions of continuously feeding soil forward while mixing same with an added soil improving material for a continuous soil treating operation.

Regardless of the type of mixing means, a batch type or a continuous type, soil treating machines are generally constructed as a fixed soil processing plant operating at a fixed place. A soil processing plant of this sort usually includes, in addition to a soil processing unit and associated components like conveyers, an untreated soil depository yard for storing sand and soil to be processed and a treated soil depository yard for storing a soil product which has been treated with a soil improving material. Sand or soil which requires a treatment usually occurs at road construction sites and in foundational ground work at building sites. The amount of sand or soil which needs a treatment varies considerably depending upon the scale and the number of ground work sites and also depending upon the frequency of such ground work. Namely, depending upon these factors, the amounts of soil which is shipped to and from a soil treating plant vary over a wide range. Accordingly, as compared with a soil processing capacity of a plant, the amount of processing soil is sometimes too small and sometimes increases to such an extent as to cause overflowing from an untreated soil depository yard.

Conceivably, large fluctuations in the amounts of soil shipments to and from a soil treating plant can be suppressed by collecting sand and soil from a broad area. In such a case, however, the plant needs to have a larger soil processing capacity, which depends not only on the capacity of a soil processing machine but also on the breadth of depository yards for untreated and treated soil. A large-scale soil processing plant which requires a large space is of course subject to various restrictions in location and environmental conditions.

Excavation of sand and soil and refilling of treated soil usually take place at road construction sites or in other foundational ground work sites. Namely, despite the fact that excavation of sand and soil and refilling treated soil take place at a higher frequency and in a far greater amount in and around heavily populated urban areas, the location of a large-scale soil treating plant which require a large space is limited to barely populated suburban areas. Besides, in order to operate a large-scale soil treating plant constantly at a suitable production rate for its capacity, sand and soil has to be collected from a large area. This means that sand and soil has to be transported to and from extremely remote places. However, transportation of sand and soil by dump trucks gives rise to the problem of so-called "dump truck pollution" along traffic routes of soil carrying trucks, in addition to the problem of high transportation costs which take an extremely large proportion in the overall cost of soil treatment. High costs of soil treatments could lead to unlawful discard and destruction of the environment.

A soil treating machine of the other type, that is, a crusher type soil treating machine is disclosed, for example, in Japanese Laid-Open Patent Specification H9-195265. This prior art soil treating machine is constructed as a vehicular or automotive type having a chassis on a crawler type base carrier. Mounted on the chassis is a soil crusher having a series of rotary crusher drums. In this case, excavated soil and an additive soil improving material are thrown into soil and additive hoppers, and fed toward the crusher drums by means of a feeder conveyer for transferring the charged soil and additive material toward the crusher drums. Treated soil is discharged out of the crusher by means of a discharging conveyer. Namely, in this case, all mechanisms necessary for the soil treatment are mounted on a vehicular body, so that the machine can be transported to and operated at a ground work site, for example, at a road construction site or other foundational ground work sites. While excavating, treating and refilling soil, the vehicular base carrier of the machine can be put in travel on and around the surfaces of a ground under treatment. Accordingly, the cost of soil treatment can be reduced to a significant degree by the use of the vehicular or automotive soil treating machine, which can obviate transportation of soil to and from a soil treating plant and a ground work site and preclude the problem of environmental pollution by dump trucks.

In case of the crusher type mixing machine as described above, soil is dropped onto rotary crusher drums from a feeder conveyer along with a soil improving material, and mixed with the latter as it is crushed into smaller pieces by beating actions of the rotary crusher drums. Therefore, in this case, soil is not necessarily mixed uniformly with a soil improving material. Of course, it may be possible to improve the degree of mixing by using a larger number of rotary beating drums. However, in order to apply crushing impacts for an increased number of times to the soil and additive improving material which are falling by gravity, the crusher needs to have a great height to secure a sufficient drop distance for soil and additive improving material. This means that the top end of a hopper on the crusher is located at an extremely great heigh, and processing soil and additive material have to be transferred to that height by means of a feeder conveyer.

As mentioned hereinbefore, the crusher type soil treating machine can be transported to and operated at a foundational ground work site. For transportation, the machine is transported to a working site on a trailer truck through public roads which usually have a limit in height of vehicles. Accordingly, for transportation on public roads, the soil treating machine as a whole is limited in height. That is to say, there is a limit to the number of crusher drums in the machine and to the number of beating or crushing actions which are available during a mixing process. In order to comply with the traffic rules on vehicle height, the number of crusher drums in the soil treating machine has to be limited to three or so, which however is insufficient for crushing and mixing excavated soil and additive soil improving material uniformly to a satisfactory degree.

A ground refilled with a non-uniform mixture of soil and an additive soil improving material is likely to suffer from uneven sinking of its foundation. In such a case, in order to stabilize the foundation free of uneven sinking, a soil improving material has to be mixed into refilling soil at a wastefully high mixing ratio, which instead might cause the foundation to harden to an excessive degree and make it difficult to excavate the ground again in a later stage, for example, for a piping work or for other purposes. Namely, considering inferior quality of treated or processed soil, the crusher type soil improving machine can find only limited applications.

Further, described in International Patent Publication WO98/53148 is a combination of a hydraulic power shovel and a soil treating mechanism. More specifically, in this case, the soil treating machine includes an upper rotary body which is rotatably mounted on a crawler type base carrier, a soil excavation means which is mounted on the upper rotary body, and a soil processing trough which is internally provided with a mixing means and located between the two crawler belts of the base carrier. Excavated soil is fed to the soil processing trough a soil hopper which is provided on top of and at one end of the soil processing trough, while a soil improving material is fed to the soil processing trough from the upper rotary body. Soil is mixed with additive soil improving material by the mixing means within the soil processing trough and discharged through a soil discharge section which is provided at the other end of the soil processing trough.

This prior art machine can produce soil of far higher quality as compared with the crusher type soil treating machine, but still has a problem in that, in order to retain the functions as a power shovel, the soil processing trough has to be located in an extremely limited space on the side of the base carrier. Therefore, this machine is suitable for use in treating a relatively small amount of soil at a foundational ground work site but unsuitable for applications which require to treat a large amount of soil efficiently within a short period of time in soil processing plants of larger scales as mentioned hereinbefore.

SUMMARY OF THE INVENTION

With the foregoing situations in view, the present inventors conducted an extensive study in an attempt to develop a soil treating machine which can mix soil and an additive soil improving material uniformly to produce a soil product of high quality efficiently at low cost and on a large scale, while suppressing traffic problems such as environmental pollution by dump trucks, and as a result succeeded in achieving the present invention on the basis of the following findings.

Firstly, a soil processing plant with a fixed soil processing system or equipments can produce soil of high quality on a large scale but involves high soil transportation costs in addition to difficulties of maintaining a suitable operational efficiency as compared with its capacity. In order to solve the problem of high soil transportation costs, it is desirable for the soil processing plant to be located as close as possible to urban areas where treated soil products are consumed in a greater amount at many foundational ground work sites. The difficulty of securing a suitable place for installation of large soil processing equipments could be overcome to some extent by effective use of a limited space.

Considering relations in geographical location of ground work sites where soil is excavated or where processed soil is consumed for refilling or for other purposes, a soil processing plant does not require a large space for its soil processing facilities as long as its service is limited to a particular area or areas. Further, in collecting and processing excavated soil, one and same depository yard can be used firstly for storing shipped-in processing soil and then for storing a processed soil product to be shipped out. By utilizing a space of soil processing facilities effectively in this manner, the space factor itself can be improved to a considerable degree. Therefore, from the standpoint of reducing transportation costs and preventing environmental pollution by dump trucks, it is more advantageous to provide a soil processing plant of relatively small size at an increased number of locations in or in the neighborhood of specific service areas.

However, operations of such small-size plants could result in a low mechanical efficiency if a fixed type soil treating machine is installed in each plant. This is because it is the general practice for a small-size plant with a small service area to receive shipments of excavated soil in a relatively small amount each time, and it takes some time until a soil depository yard of each plant becomes full. Therefore, in terms of mechanical efficiency, it is more advantageous to send one soil treating machine to soil depository yards of a number of soil processing plants rather than installing a fixed type soil treating machine in each one of small-size plants.

Consequently, the mechanical efficiency of a soil treating machine can be improved to a conspicuous degree by providing a soil treating network system covering a number of small-scale soil treating yards equipped with relatively simple facilities and located in various locations in a number of neighboring service areas, each yard being arranged, for effective use of a space allotted thereto, using one soil depository space both for untreated soil to be shipped in and for a treated soil product to be shipped out, and an automotive soil treating machine which can be sent to one of the soil treating yards as soon as its soil depository yard becomes full of untreated soil. Establishment of such a soil treating system which is constituted by a number of small-scale soil treating yards makes it possible to produce treated soil of high quality efficiently on a large scale in total and at a considerably reduced cost, shortening the distances of soil transportation by dump trucks and as a result lessening troubles with the existing traffic system.

A soil treating machine to be used for this purpose should have a self-contained mobile soil treating system preferably of compact construction. Besides, the machine should be able to produce soil of good quality in a stable manner, and have a capacity of processing a large amount of soil efficiently within a shortened period of time.

Accordingly, it is an object of the present invention to provide a vehicular or automotive soil treating machine of compact construction which can be transported from one place to another, contributing, for example, to establishment of a soil treating system suitable for a small-scale soil treating yard, and which can process soil of inferior quality into an improved soil product efficiently in an accelerated manner.

It is another object of the present invention to provide an automotive soil treating machine which can be easily transported by the use of a trailer car or other transportation means to process soil into a soil product of improved quality at a place where soil of inferior quality occurs or at a soil depository yard.

It is still another object of the present invention to provide an automotive soil treating machine which can produce soil of improved quality which consists of a uniform mixture of soil and an additive soil improving material or agent.

It is a further object of the present invention to provide an automotive soil treating machine which can accurately adjust a mixing ratio of an additive soil improving material to processing soil.

It is a further object of the present invention to provide an automotive soil treating machine suitable for use in treating weak soil uniformly with a solidifying agent such as lime, cement or the like before refilling the soil into an excavated ground or for strengthening foundational soil construction.

In accordance with the present invention, the above-stated objectives are achieved by the provision of an automotive soil treating machine which essentially comprises: a main frame mounted on an automotive drive means and providing thereon at least a soil feeding stage, a soil processing stage and a soil discharging stage; the soil feeding stage including at least a soil hopper and an additive hopper for supplying processing soil and an additive soil improving material to the soil processing stage; the soil processing stage including a soil processing trough of generally cylindrical shape mounted on the main frame and having an inlet opening on an upper side of a front end portion thereof to receive processing soil and additive soil improving material therethrough, and an outlet opening on a lower side of a rear end portion thereof, and a rotary mixing means rotatably supported within the soil processing trough and adapted to transfer soil and additive soil improving material substantially horizontally through the processing trough while mixing same uniformly with each other; and the soil discharging stage including a soil discharging conveyer adapted to receive processed soil through the outlet opening of the soil processing trough and transfer same in a predetermined direction.

In a specific form of the present invention, the rotary mixing means is constituted by a rotary paddle mixer having a plural number of rotary paddle assembly units, each having a plural number of mixing paddles attached on a rotational shaft in a predetermined pitch. For example, two or three rotary paddle assembly units are extended axially through the soil processing trough, and preferably the rotational shafts of the respective rotary paddle assembly units are adapted to rotate in an opposite direction relative to an adjacently located paddle assembly unit. In this instance, one of the rotational shafts of said rotary paddle assembly unit is driven from a hydraulic motor and rotationally coupled with a rotational shaft or shafts of other rotary paddle assembly units or unit. The rotational shafts of the rotary paddle assembly units are supported in bearings in front and rear end portions thereof, and, for smooth transfer of soil and additive soil improving material through the processing trough, the inlet and outlet openings of the soil processing trough are located between the paddle unit bearings.

Preferably, in order to produce mixing effects to an extreme degree on soil and additive soil improving material within a trough of a minimum size, the above-mentioned soil processing trough is arranged to have a total length approximately three times as large as an axial pitch of paddles on the rotational shafts of the rotary paddle assembly units of the paddle mixer. For the same reason, paddles are preferred to be arranged to have a diameter corresponding to ⅓ of the total length of the soil processing trough.

The soil feeding stage may employ a feeder conveyer which is adapted to receive processing soil and additive soil improving material from the soil hopper and the additive hopper, respectively, and to feed received soil and additive material to the inlet opening of the soil processing trough. In this instance, preferably the feeder conveyer is arranged to have a sloped transfer surface to transfer the received soil and additive material in an obliquely upward direction toward the inlet opening of the soil processing trough, and the soil hopper is located over an upstream end of the transfer surface of the feeder conveyer while the additive hopper is located over the transfer surface on a downstream side of the soil hopper. Further, in the discharging stage, preferably the discharging conveyer is adapted to transfer processed soil in an obliquely upward direction from a position under the outlet opening of the soil processing trough, and provided with an inwardly foldable extension at an upper end thereof. Besides, in this instance, a machine chamber can be located over a rear end portion of the soil processing trough with the outlet opening.

The automotive soil treating machine according to the present invention may further include a soil feed measuring means for measuring an amount of processing soil supplied from the soil hopper. Besides, the additive hopper may be adapted to be able to adjust a feed rate of the additive soil improving material in relation with a soil transfer rate measured by the soil feed measuring means for maintaining a constant mixing rate of the additive soil improving material to processing soil.

Further, arrangements may be made to feed soil and additive soil improving material to the soil processing trough directly from the soil and additive hoppers. In such a case, the soil hopper is located over one end of the soil processing trough to supply processing soil directly thereto, and the additive hopper is arranged to supply additive soil improving material to the soil processing trough from a position on the rear side of and at a predetermined distance from the soil hopper. Further, an additive feed rate control means may be provided on the additive hopper to adjust an additive feed rate to the soil processing trough, in combination with a rotational speed sensor which is adapted to detect rotational speed of the paddle mixer rotational shafts, permitting the additive feed rate control means to adjust the feed rate of the additive material in relation with the rotational speed of the paddle mixer rotational shafts. Preferably, the soil processing trough is provided with a gate for controlling a soil feed rate. Further, for controlling the additive feed rate, the additive hopper may include a rotary type quantitative feeder which is driven from a variable speed electric motor to function as an additive feed rate control means. In this case, the rotational speed of the variable speed electric motor is adjusted by a controller using a signal from the rotational speed sensor of the paddle mixer rotational shafts as a control signal.

The above and other objects, features and advantages of the present invention will become apparent from the following particular description, taken in conjunction with the accompanying drawings which show by way of example some preferred embodiments of the invention. Needless to say, the present invention is not restricted to particular forms in the drawings which are shown only for illustrative purposes.

DESCRIPTION OF PREFERRED EMBODIMENTS

Figure 1:
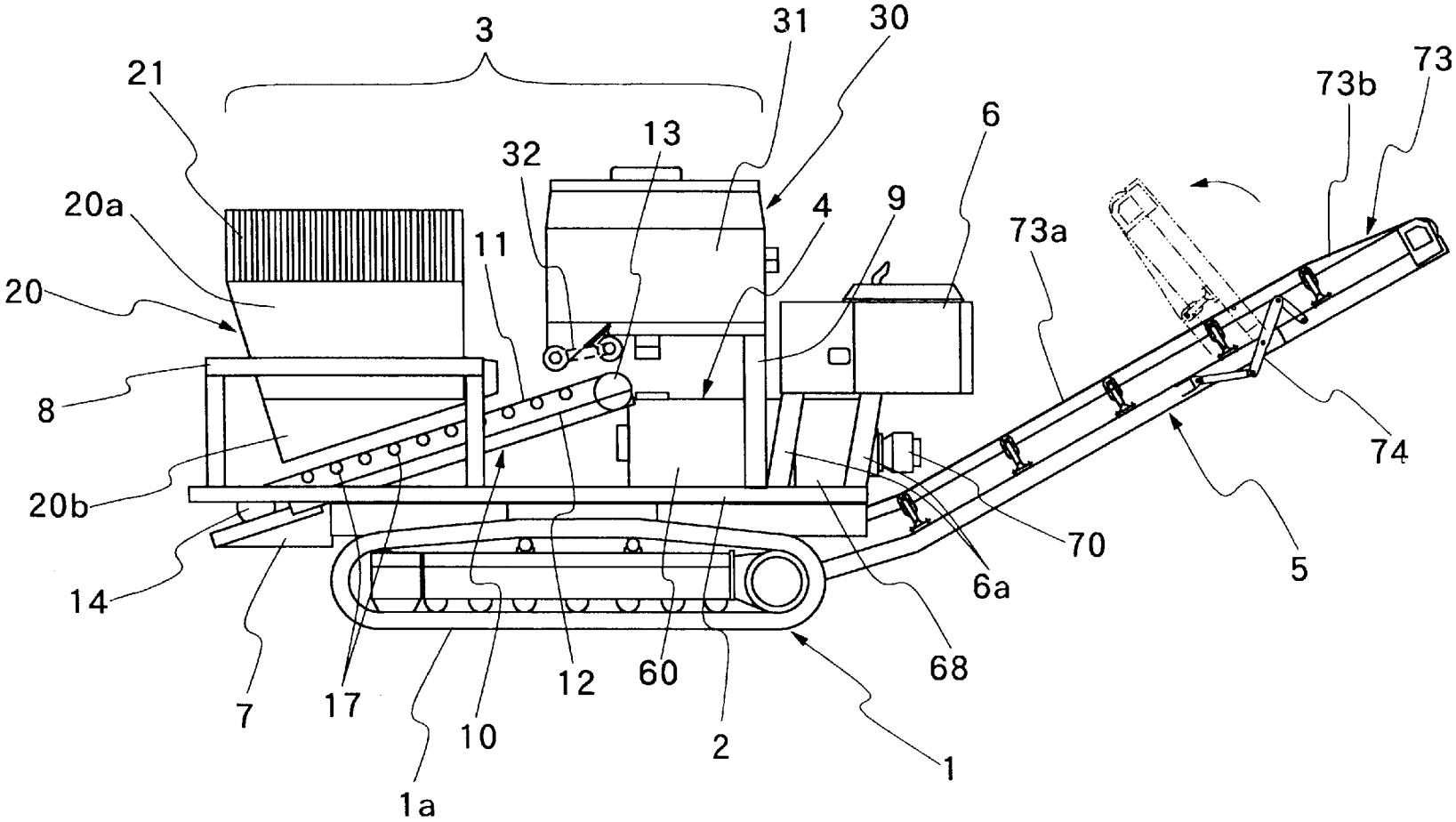
FIG. 1 is a schematic view of an embodiment of the automotive soil treating machine according to the present invention.
Figure 2:
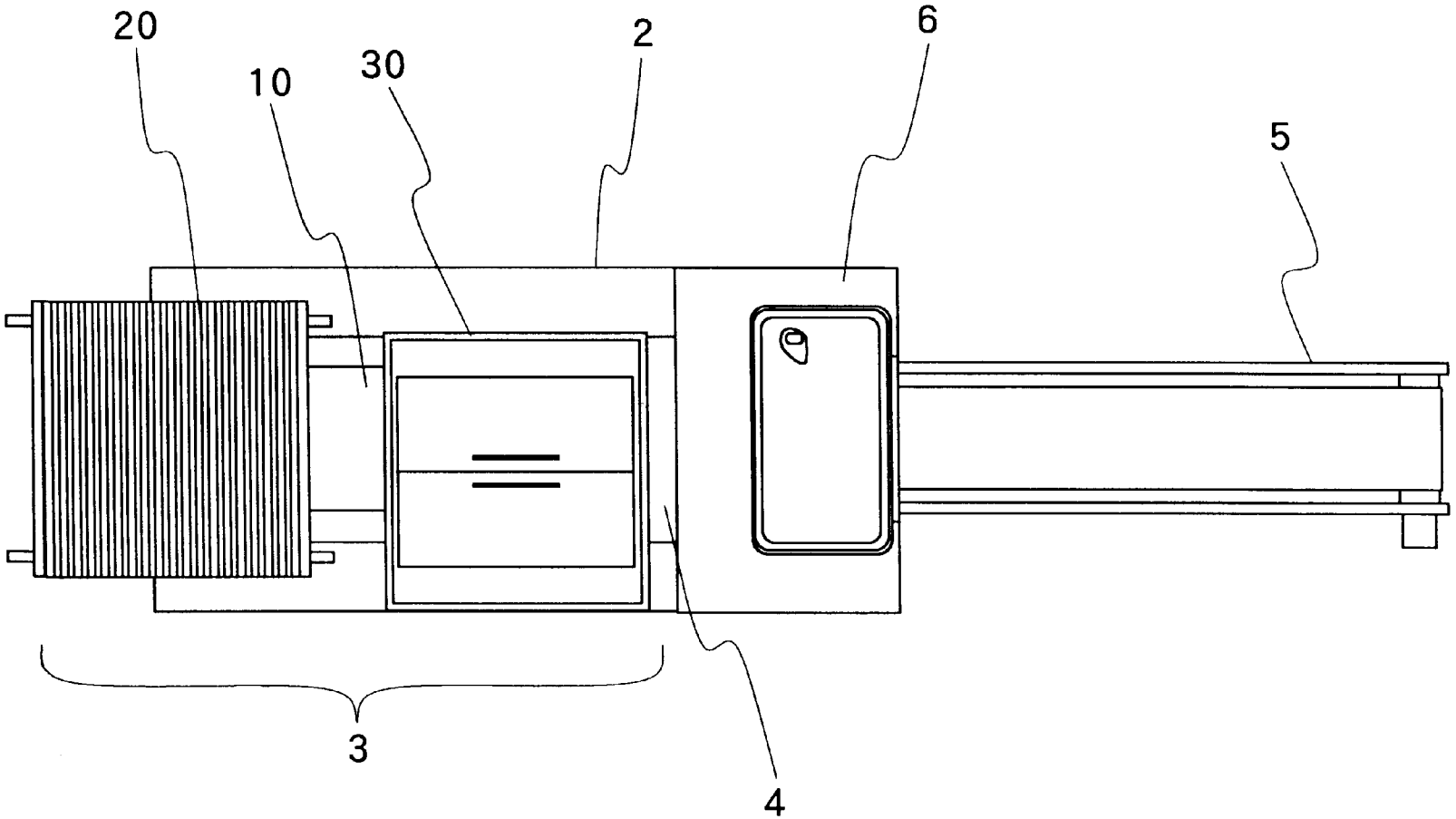
FIG. 2 is a schematic plan view of the soil treating machine of FIG. 1.
Figure 3:
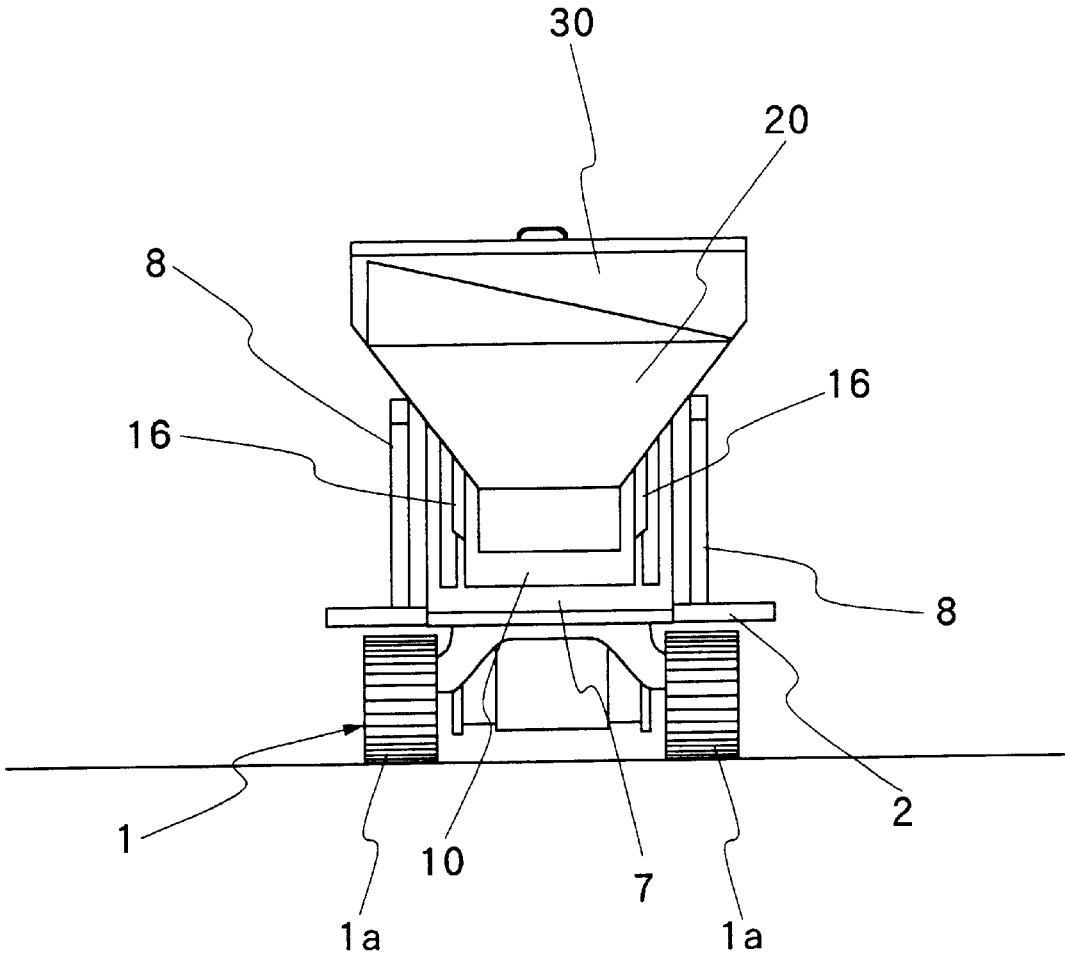
FIG. 3 is a left-hand side view of the soil treating machine of FIG. 1.

Hereafter, the invention is described more particularly on the basis of its preferred embodiments shown in the accompanying drawings. Shown in FIGS. 1 to 3 is an automotive or vehicular soil treating machine according to the present invention. In FIG. 1, indicated at 1 is base carrier of the machine, which is of a crawler type vehicle having crawler belts 1*a* in the manner well known in the art. Since the base carrier 1 is a crawler type, it can prevent the machine as a whole from being destabilized, for example, by impacts of load when excavated soil is thrown into the machine. However, the base carrier may be a wheel type vehicle in case arrangements are made to charge excavated soil continuously by the means of a conveyer or the like.

Mounted on a main frame 2 of the base carrier 1 are a soil feed stage 3 on its front portion, a left-hand portion in FIG. 1, and, a soil processing stage 4 which is positioned behind the feed section 3. Further, a soil discharge stage 5 is provided behind the soil processing section 4. The soil discharge stage 5 is extended obliquely upward from a lower position of the processing stage 4. Located above the soil processing stage 4 is a machine chamber 6 which houses mechanical components such as engine, hydraulic pump, directional change-over valve unit etc. The machine chamber 6 is mounted on support posts 6*a* which are erected on the main truck frame 2.

The soil feed stage 3 includes, along with a feed mechanism for excavated soil and additive soil improving material, a metering mechanism for measuring soil feed rate. Further provided in the soil feed stage 3 is a feeder conveyer 10 which transfers soil and additive soil improving material toward the processing stage 4. A soil hopper 20 is located over the feeder conveyer 10 at an upstream position in the transfer direction of the feeder conveyer 10, and an additive hopper 30 is located at a position rearward of the soil hopper 20. Soil feed rate is measured by the feeder conveyer 10, and an additive feed rate through the additive hopper 30 is adjusted according to a measured soil feed rate.

The feeder conveyer 10 is supported on an extension frame 7 which is projected forward of the main truck frame 2. The extension frame 7 is sloped upward from its fore end, which is at the lowest level, to its rear end which is connected to the main truck frame 2. Accordingly, the feeder conveyer 10 which is supported on the extension frame 7 is sloped upward from its fore end to its rear end. In order to facilitate soil charging through the hopper 20, the fore end of the feeder conveyer 10 is positioned at the lowest operative level, which is higher than treading surfaces of the crawler belts 1*a* but lower than the main truck frame 2.

Figure 4:
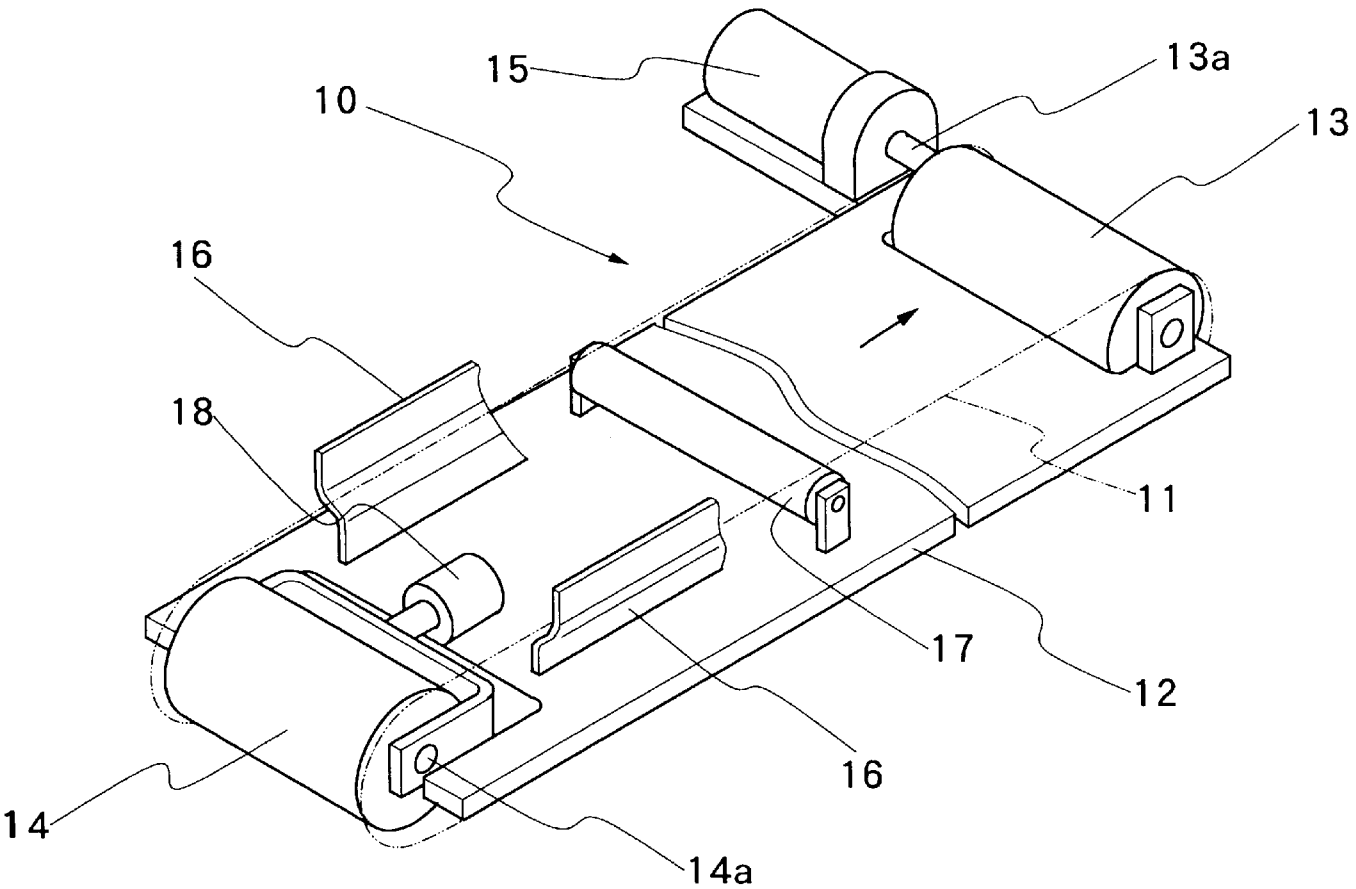
FIG. 4 is a schematic view of a feeder conveyer.

As shown in FIG. 4, the feeder conveyer 10 is provided with a carrier belt 11 of an endless shape (indicated by imaginary lines) formed of a rubber sheet or a similar material which can flex itself to a certain degree depending upon the weight of an applied load. Further, indicated at 12 is a conveyer frame which rotatably supports rotational shafts 13*a* and 14*a* transversely at its opposite ends for a drive roller 13 and a driven or follower roller 14, respectively. The endless carrier belt 11 is passed around the drive roller 13 and follower roller 14. The rotational shaft 13*a* of the drive roller 13 is coupled with a hydraulic motor 15. Accordingly, as the rotational shaft 13*a* is rotationally driven by the hydraulic motor 15, the carrier belt 11 is turned by the drive roller 13 in the direction indicated by an arrow in FIG. 4.

Provided on and along the opposite sides of a load carrying surface of the carrier belt 11 are guide plates 16, which have the respective upper ends projected above the load carrying surface of the carrier belt 11 by a predetermined length. These guide plates 16 function as blocking walls which prevent heaps of soil on the carrier belt 11 from overflowing to the lateral sides of the transfer path. Further, a number of guide rollers 17 are provided under the carrier belt 11 at predetermined intervals in and along the transfer path. The rotational shaft 14*a* of the follower roller 14 is connected to the conveyer frame 12 not directly but indirectly through a tension adjustor means 18 which functions to maintain a constant tension in the carrier belt 11. Although not shown particularly in the drawings, the tension adjustor means 18 includes a tension detector means thereby to adjust the tension of the carrier belt 11 to a predetermined value.

Figure 5:
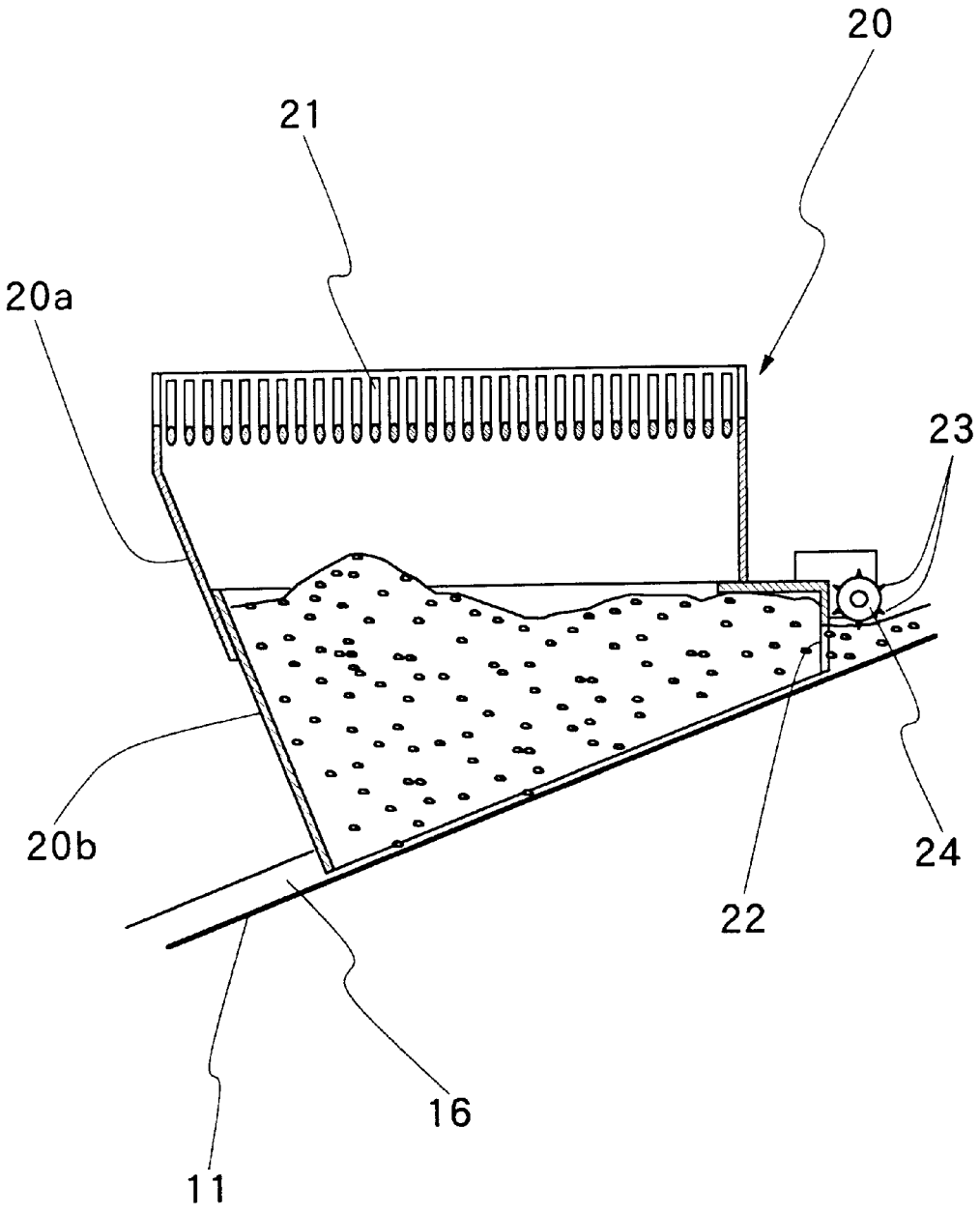
FIG. 5 is a schematic sectional view of a soil hopper.
Figure 6:
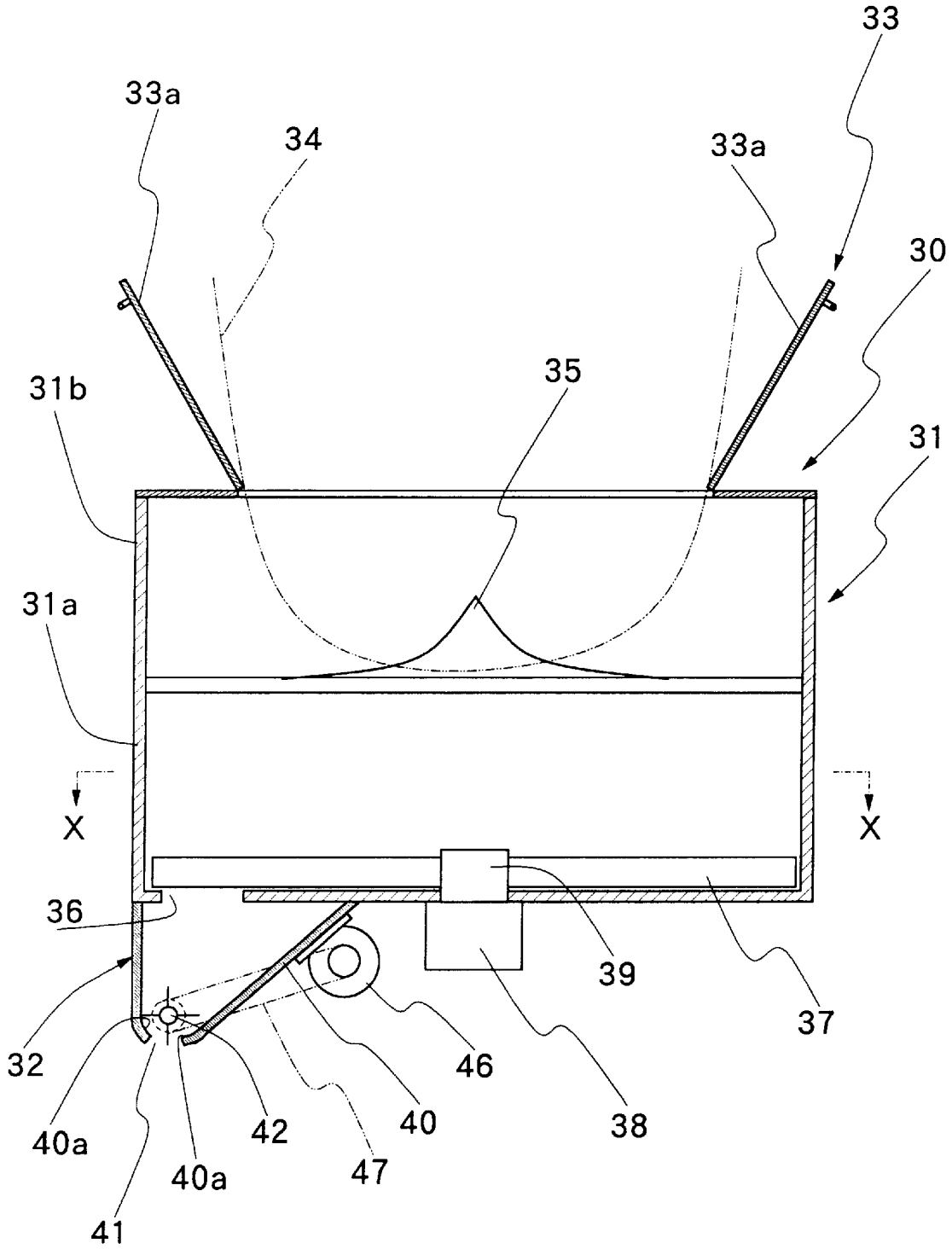
FIG. 6 is a schematic sectional view of a hopper for an additive soil improving material.

The soil hopper 20 is constituted by a box-like frame structure which is open on the upper and lower sides thereof. As shown particularly in FIG. 5, the soil hopper 20 consists of an upper frame section 20*a* which receives soil from above, and a lower frame section 20*b* which supplies soil to the feeder conveyer 10. The upper frame section 20*a* of the soil hopper 20 is diverged toward its upper open end so that soil can be smoothly thrown into the hopper 20. On the other hand, the lower frame section 20*b* is converged toward its open bottom end through which soil is fed to the feeder conveyer 10. More specifically, toward the bottom end, the lower frame section 20*b* is converged to a width as large as or slightly smaller than that of the carrier belt 11 of the feeder conveyer 10. The soil hopper 20 is fixedly retained on the main truck frame 2 through a frame member 8.

A sieve means 21 such as a sieving plate or a grating plate, for example, is provided in the upper frame section 20*a* of the soil hopper 20 thereby to sieve out foreign matter. The sieve means 21 may be provided fixedly at the mouth of the upper frame section 20*a* of the soil hopper 20, or may be adapted to be vibrated within the upper frame section 20*a* by the use of a vibrational drive means. The upper open end of the upper frame section 20*a*, which is fitted with the sieve means 21, is inclined to one side. Therefore, when excavated soil is thrown into the soil hopper 20 from front side by the use of a bucket of a hydraulic power shovel, for example, soil is selectively passed through the sieve means 21, while blocks of solid foreign matter which cannot pass through the sieve means 21 are caused to fall down along the inclined sieve means 21.

The soil which has been thrown into the soil hopper 20 is allowed to drop on the carrier belt 11 of the feeder conveyer 10 by gravity through the lower frame section 20*b*, and fed forward by the carrier belt 11. It is not necessarily a mandatory requisite, but it is desirable to adjust the feed rate of soil by the carrier belt 11 and to suppress fluctuations in the soil feed rate as much as possible, for the purpose of mixing an additive soil improving material at a constant mixing ratio on the basis of the soil feed rate as will be described hereinlater.

Since the top surface of the soil layer on the carrier belt 11 should be limited to the level of the projected upper ends of the guide plates 16, a gate 22 is provided at an exit at the bottom end of the soil hopper 20. The gate 22 has an open gate area of a height which limits the height of soil leaving the hopper 20 up to a level not exceeding the upper projected ends of the guide plates 16. Accordingly, as the carrier belt 11 is put in motion, soil is transferred onto the carrier belt 11 in a thickness as preset by the height of the gate 22. Besides, a leveler roller 24 with claws 23 is rotatably supported on the outer side of the gate 22 thereby to level the top side of soil being fed forward past the gate 22. Consequently, soil is transferred forward by the carrier belt 11 constantly in a predetermined height or thickness.

The hopper 30 for an additive soil improving material is fixedly retained in position on the main truck frame 2 by means of posts 9, and arranged as shown particularly in FIGS. 6 to 9. In this instance, for soil improvement, various additive materials can be blended into soil depending upon the purpose of use. For instance, for producing soil to be refilled into an excavated ground or to be used for improvement of a foundational, lime and cement are mixed into soil along with other additives if necessary. Different additive soil improving materials are used according to the purpose of use, for example, for improving clay soil, for imparting cushioning properties to a ground or for improving soil of an agricultural field.

The additive hopper 30 is largely constituted by an additive reservoir portion 31 and an quantitative feeder 32. The reservoir 31 includes an upper section 31*b* of a rectangular box-like shape and a lower cylindrical section 31*a*. The upper rectangular box-like section 31*b* is provided with a lid 33 which is constituted by a couple of hinged lid plates 33*a*. The lid plates 33*a* can be swung open away from each other in outward directions and retained in upwardly spread positions by suitable stoppers. An additive soil improving material is supplied to the hopper 30 from a flexible container bag 34 which is filled with an additive soil improving material and placed in the upper rectangular box section 31*b* of the reservoir 31 through and between the upwardly spread lid plates 33*a*. An upwardly projecting cutter blade 35 is provided at the bottom of the upper box section 31. Therefore, upon setting a flexible container bag 34 in the additive hopper 30, a bottom portion of the flexible container bag 34 is cut open by the cutter blade 35, and the additive soil improving material in the flexible container bag 34 is allowed to flow down into the lower cylindrical section 31*a* of the reservoir 31. As soon as the additive soil improving material is charged into the hopper 30 in this manner, the lid 33 is closed to prevent the additive material from scattering on or around the machine.

Figure 7:
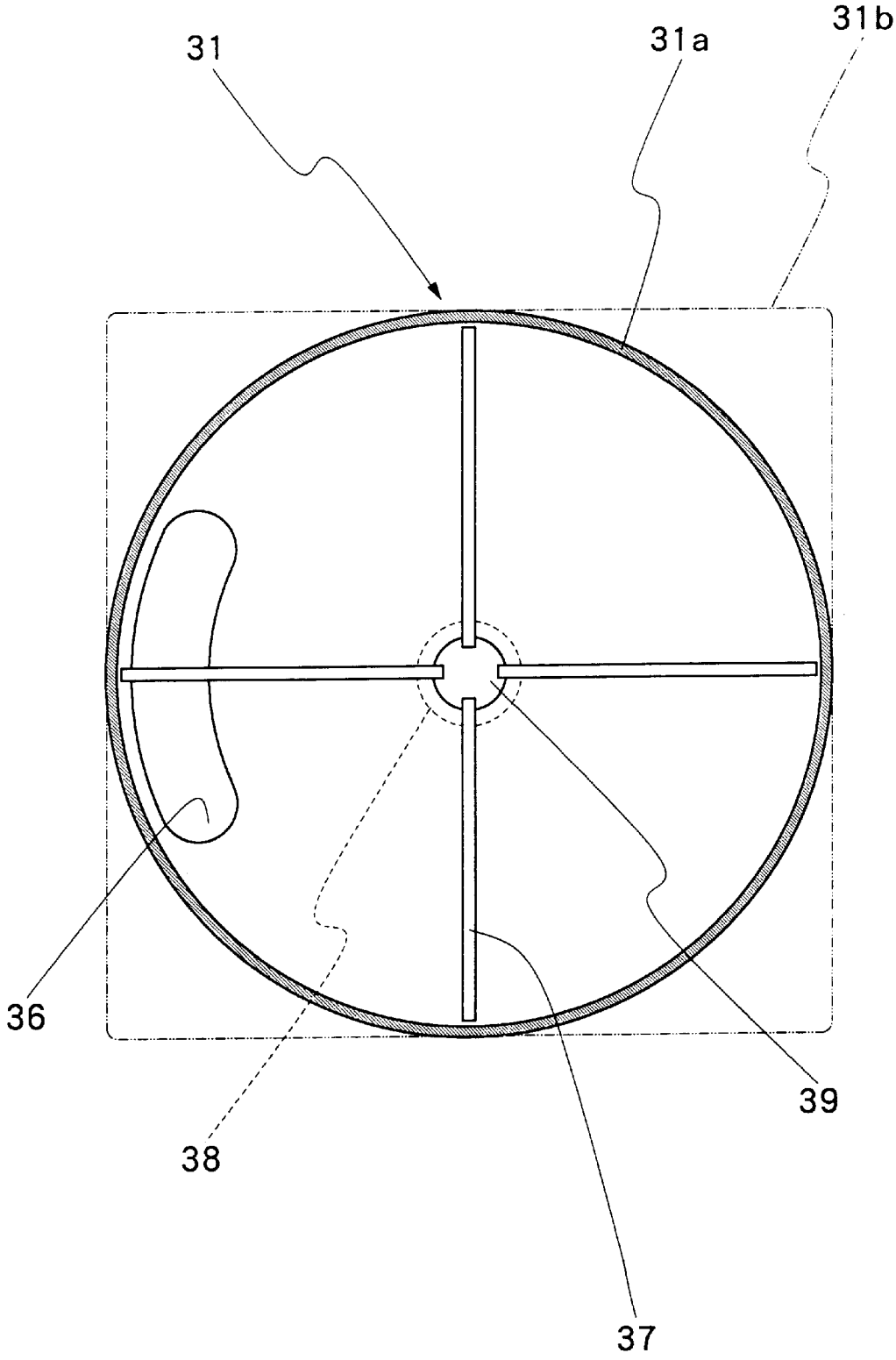
FIG. 7 is a sectional view taken on line X—X of FIG. 6.

As clear from FIG. 7, through an aperture 36, the lower cylindrical section 31*a* is communicated with the quantitative feeder section 32. Therefore, the additive soil improving material in the lower cylindrical section 31*a* of the reservoir 31 is allowed to flow into the quantitative feeder section 32 through the aperture 36. In this instance, the aperture 36 is arranged to have a relatively small open area as compared with the whole sectional area of the lower cylindrical section 31*a*. Therefore, if the additive soil improving material is supplied to the quantitative feeder section 32 by the gravitational flow alone, its smooth supply to the quantitative feeder section 32 could be hindered by a bridging phenomenon. In order to avoid bridging phenomena, a cross-rod turning gate 37 is provided at or in the vicinity of a bottom portion of the lower cylindrical section 31*a* of the reservoir 31. The cross-rod turning gate 37 is coupled with and rotationally driven from a hydraulic motor 38 which is provided on the lower side of the lower cylindrical section 31*a*. As the turning gate 37 is put in rotation, soil in the bottom portion of the cylindrical section 31*a* is agitated and urged to flow into the quantitative feed section 32 smoothly without stagnations.

The quantitative feed section 32 includes a casing 40 which has a width substantially same as that of the carrier belt 11 of the feeder conveyer 10. Provided at the lower end of the casing 40 is an additive feed port 41 in the form of a slot having a length substantially corresponding to or slightly smaller than the width of the carrier belt 11. The additive material which has been sent into the quantitative feed section 32 from the reservoir 31 is added, through the additive feed port 41, to the soil which is being transferred by the carrier belt 11. In supplying the additive soil improving material to the carrier belt 11, it is not necessarily required to distribute it over the entire width of the carrier belt 11. If desired, the feed section 32 may be arranged to supply an additive material to a center portion of the carrier belt 11.

Figure 8:
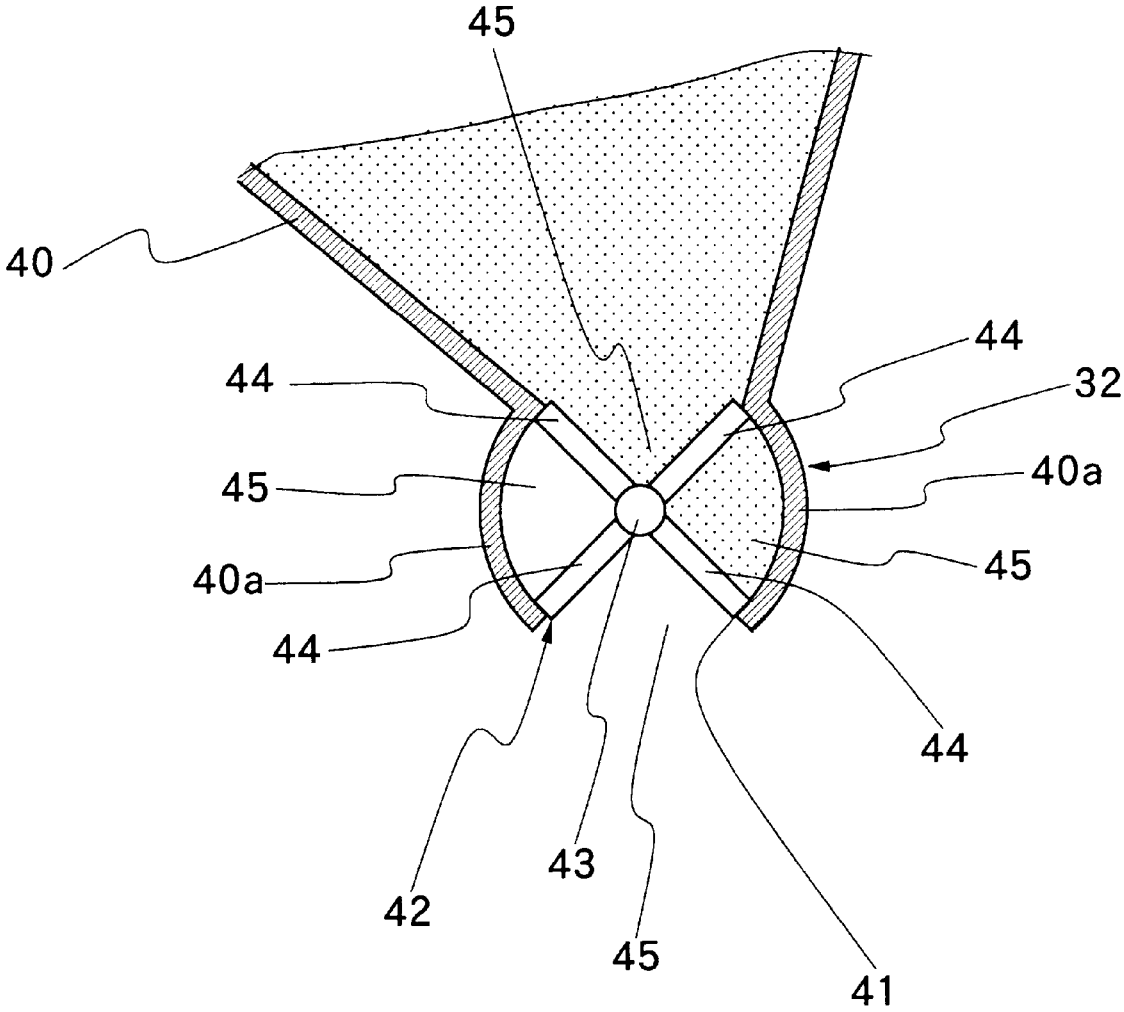
FIG. 8 is a schematic sectional view of a quantitative feed mechanism.
Figure 9:
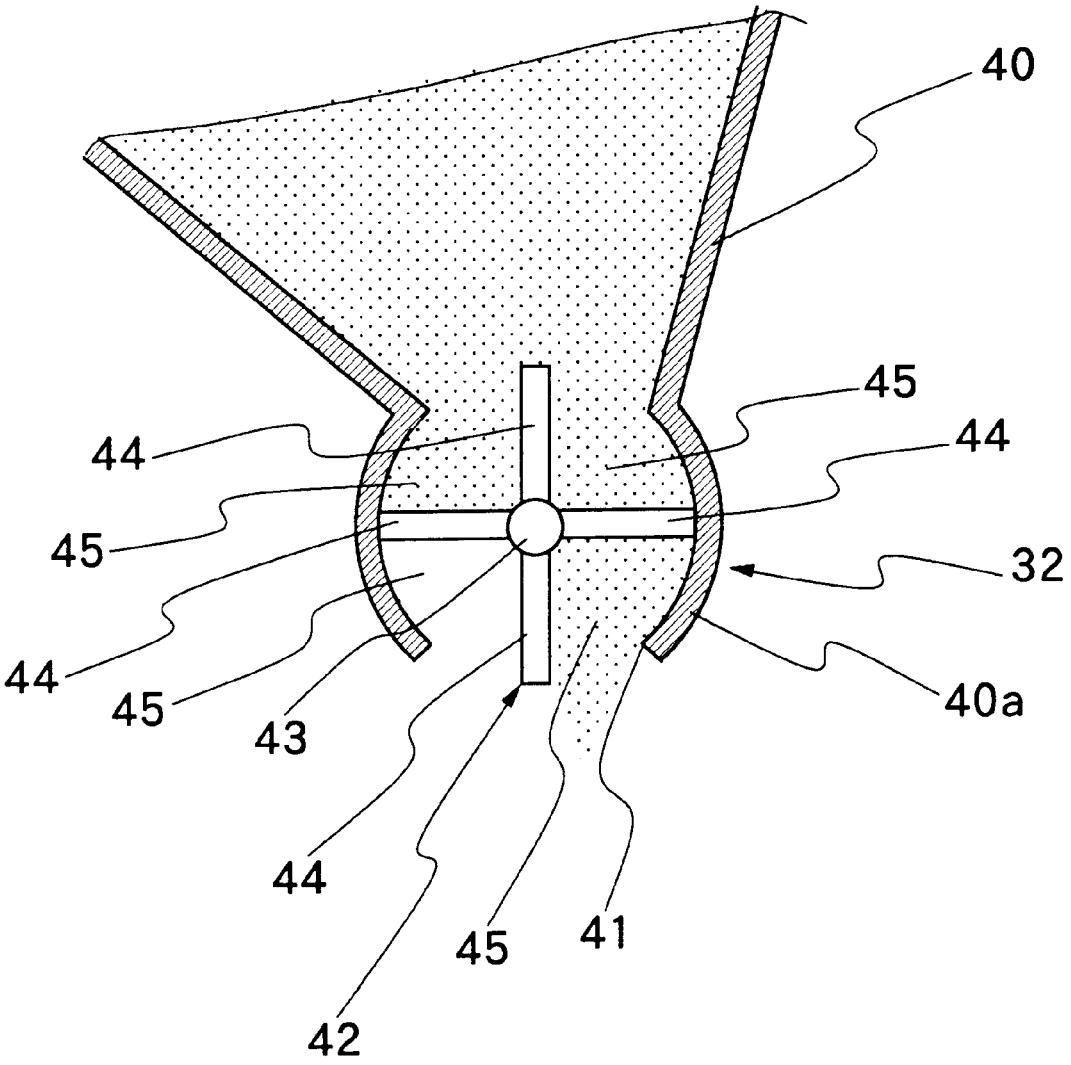
FIG. 9 is a view similar to FIG. 8 but showing the quantitative feed mechanism in a different phase of operation.

The feed rate of the additive soil improving material from the quantitative feed section 32 is adjustable. More particularly, as shown in FIGS. 8 and 9, lower end portions of the casing 40, which led to the above-mentioned additive feed port 41, are enclosed by arcuate walls 40*a* on the front and rear sides thereof, and a quantitative feeder 42 is rotatably mounted between the arcuate walls 40*a*. The quantitative feeder 42 is constituted by a rotational shaft 43 horizontally passed through lower end portions of the casing 40, and a number of radial partition walls 44 which are provided at predetermined angular intervals (at intervals of 90 degrees in the particular embodiment shown) around the circumference of the rotational shaft 43 in such a way as to define a V-shaped quantitative metering container 45 between the adjacent partitions walls 44. In this instance, the width of the additive feed port 41 is substantially as large as or slightly narrower than the intervals between the outer ends of the adjacent partition walls 44. The arcuate walls 40*a* form at least an arc of 90 degrees or more.

When the rotational shaft 43 is put in rotation, the four partition walls 44 which constitute the quantitative metering containers 45 are turned around the rotational shaft 43, with the respective outer ends in sliding contact with the arcuate walls 40*a*. Accordingly, the arcuate walls 40*a* function to cut out excessive soil from the respective quantitative metering containers 45. On each ¼ revolution of the rotational shaft 43, the quantitative feeder 42 which is in the position of FIG. 8, for example, is shifted to the position of FIG. 8 to supply a predetermined quantity of soil, which corresponds to the inner volume of each quantitative metering container 45, onto the carrier belt 11 of the feeder conveyer 10. Therefore, the feed rate of the additive soil improving material from the quantitative feed section 32 can be adjusted by varying the operating speed of the rotational shaft 43. In order to permit fine adjustments of the operating speed of the rotational shaft 43, an output shaft of an electric motor 46 which is mounted on the casing 40 on the outer side of the casing 40 is coupled with the rotational shaft 43 through a power transmission means 47 such as a transmission belt or the like.

Figure 10:
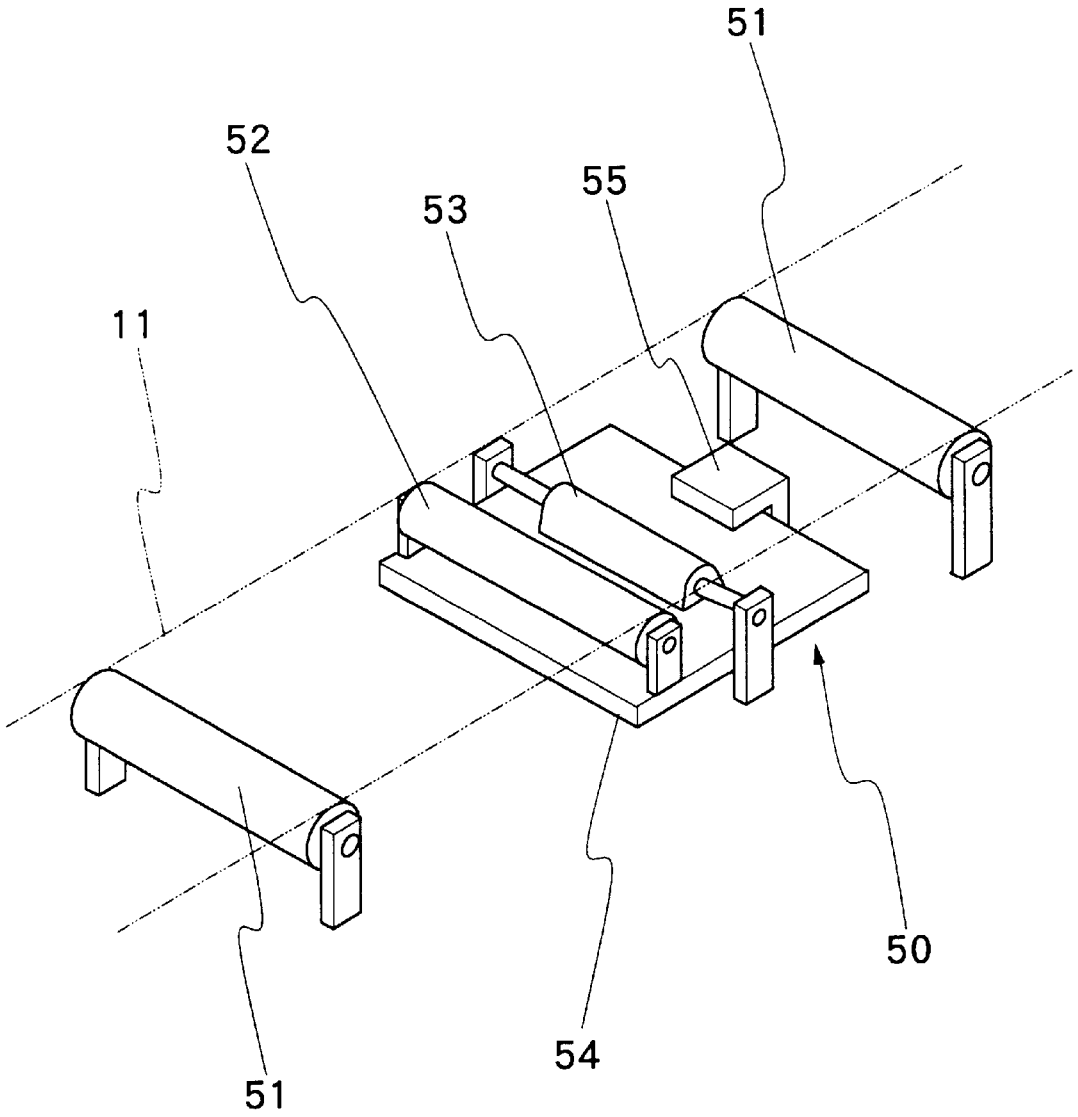
FIG. 10 is a schematic illustration of a soil feed measuring means.
Figure 11:
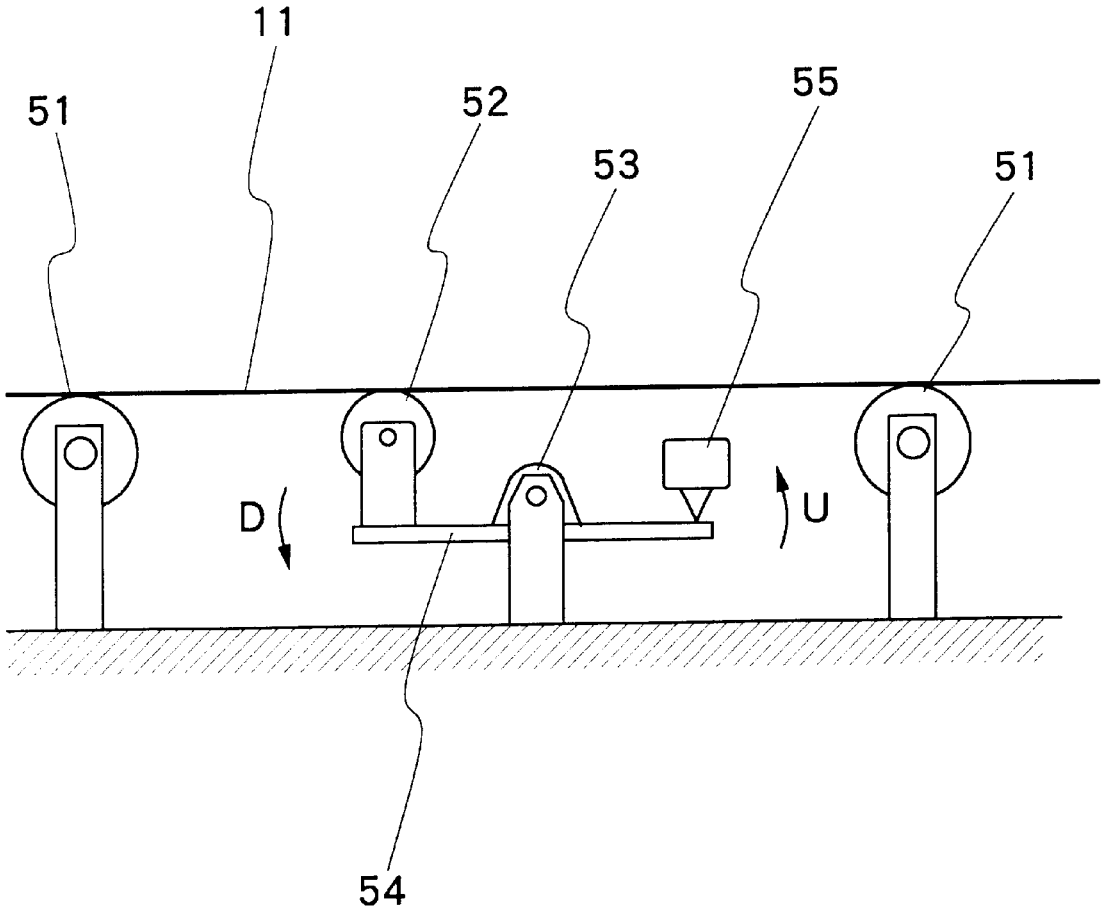
FIG. 11 is a schematic illustration explanatory of the principles of measuring a soil feed amount or rate.
Figure 12:
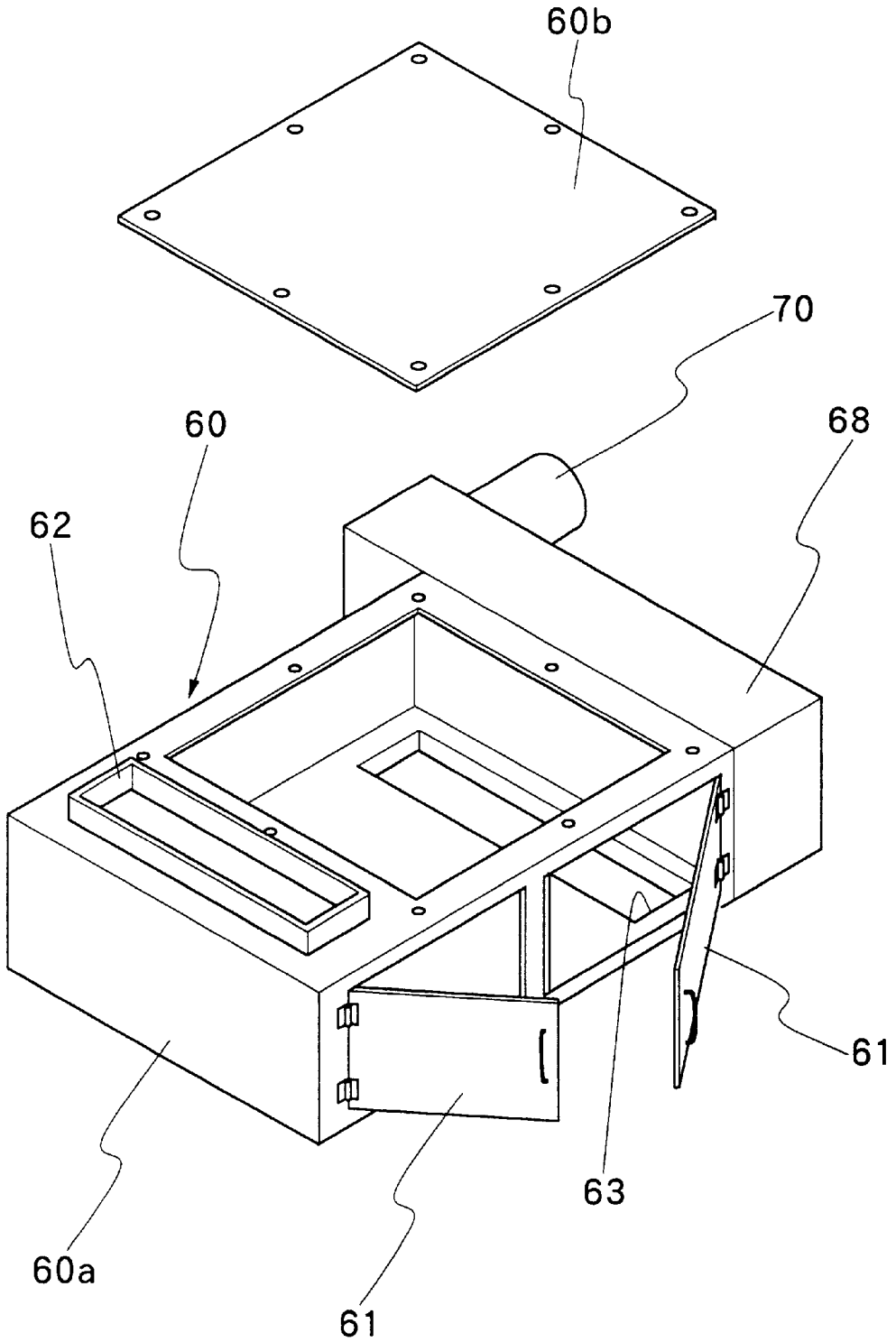
FIG. 12 is a schematic outer view of a soil processing trough, with a paddle mixer omitted therefrom to show the interior of the processing trough.

The feed rate of the additive soil improving material is varied according to the feed rate of soil which is transferred by the carrier belt 11 of the feeder conveyer 10. The amount of soil which is transferred by the carrier belt 11 is adjusted to some extent by the gate 22 and the leveler roller 24 which function to level off the height or thickness of the soil layer on the carrier belt but are unable to keep a constant soil transfer rate accurately. Therefore, a soil feed measuring means 50 is provided on the feeder conveyer 10 for the purpose of detecting the amount of soil which is transferred by the carrier belt 11. More particularly, the soil feed measuring means 50 is adapted to detect the weight of soil which is transferred by the carrier belt 11, and arranged as shown in FIGS. 10 and 11 in construction.

In these figures, indicated at 51 are a pair of rollers which are supported fixedly in spaced positions on the conveyer frame 12 and are caused to roll about themselves by abutting contact with the back side of the moving carrier belt 11. A soil feed measuring zone is defined between these fixed rollers 51. The soil feed measuring zone includes a weight measuring roller 52 which is located approximately in an intermediate position between the two fixed rollers 51 and in abutting contact with the back side of the carrier belt 11. In this instance, the weight measuring roller 52 detects the degree of flexure of the carrier belt 11 which is made of a flexible material and flexes itself downward according the weight of loaded soil as described hereinbefore.

For this purpose, the weight measuring roller 52 is mounted on one end portion of a rocking plate 54 which is rockably supported on the main frame 12 through a bearing member 53. Connected to the other end of the rocking plate 54 is a load sensor 55 having a load cell or the like as a weight measuring means. Accordingly, when the running carrier belt 11 is loaded with a pile of soil, it is caused to sink down by flexure under the weight of the piled soil as soon as it comes to the soil feed weight measuring zone between the fixed rollers 51. As a result, the weight measuring roller 52 is pushed down in the direction of arrow D in FIG. 11, and the other end of the rocking plate 54 which is connected with the weight measuring roller 52 is displaced in the direction of arrow U to exert an increased load on the load sensor 55. Thus, the amount of soil which is transferred by the carrier belt 11 can be measured on the basis of detection signals by the load sensor 55.

In this connection with the feeder conveyer 10, the transfer distance of the carrier belt 11 which serves to feed excavated soil and additive soil improving material can be shortened if the soil hopper 20 and the additive hopper 30 are located as close to each other as possible. However, since the soil feed measuring means 50 is provided between the hoppers 20 and 30 as described above, the length of the carrier belt 11 is required to have an increased length. In this regard, there is no necessity for the carrier belt 11 to have a conspicuously increased length because both of the soil hopper 20 and the additive hopper 30 have a predetermined volume and therefore allow to make a space for the soil feed measuring means 50 under the carrier belt 11. Nevertheless, the soil layer on the carrier belt 11 is leveled off to a predetermined height or thickness by the gate 22 and the leveler roller 24, the soil feed measuring means 50 may be omitted in case little space is available for its installation.

In the manner as described above, soil and additive soil improving material are transferred by the carrier belt 11 toward the other end of the feeder conveyer 10, which is connected a soil processing trough 60 of the processing stage 4. The soil processing trough 60 is largely constituted by a main body 60*a* which is provided with an opening on the top side over a predetermined range, and a lid member 60*b* which detachably fixed to the main body to close the top opening. The main body 60*a* is fixedly mounted on top of the main truck frame 2. The machine chamber 6 which is located over the lid member 60*b* is not in contact with the latter. Accordingly, the lid member 60*b* can be removed or separated from the main body 60*a* which is mounted in an operative position on the main frame 2.

The soil and additive soil improving material which have been transferred by the carrier belt 11 are supplied to the soil processing trough 60 from above to undergo a mixing or blending process within the latter. For this purpose, the feeder conveyer 10 normally needs to be located in a high position over the processing trough 60. In case the feeder conveyer 10 is supported horizontally on the main frame 2, the soil hopper 20 would have to be located in a far higher position which is inconvenient for throwing in excavated soil. In this regard, according to the present invention, the feeder conveyer 10 is supported on the sloped extension frame 7 which is projected obliquely downward from the main truck frame 2. With this arrangement, the upstream end of the feeder conveyer 10 as well as the soil hopper 20 is located in a low position at which excavated soil can be thrown in an extremely facilitated manner.

Figure 13:
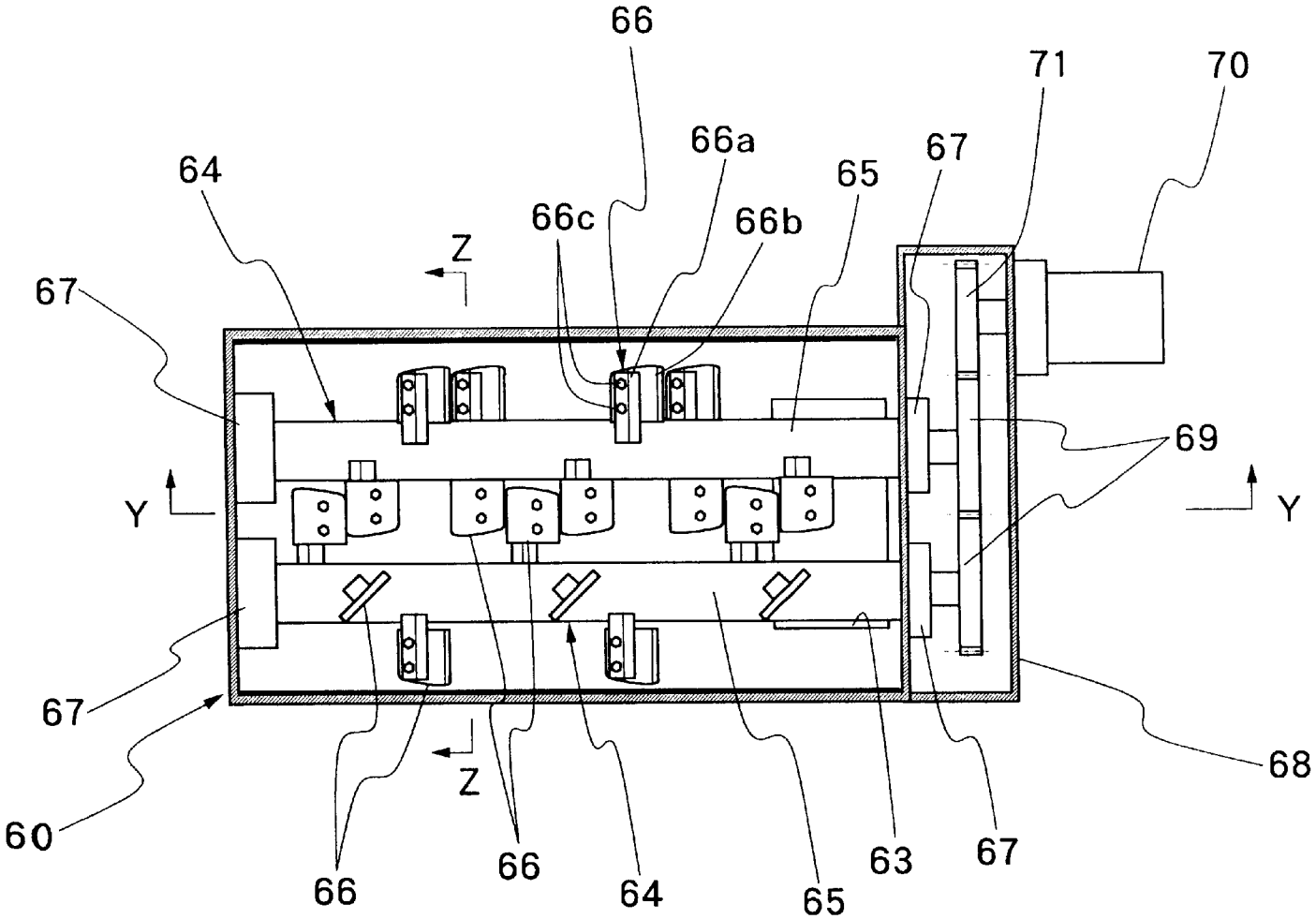
FIG. 13 is a transverse sectional view of the soil processing trough.
Figure 14:
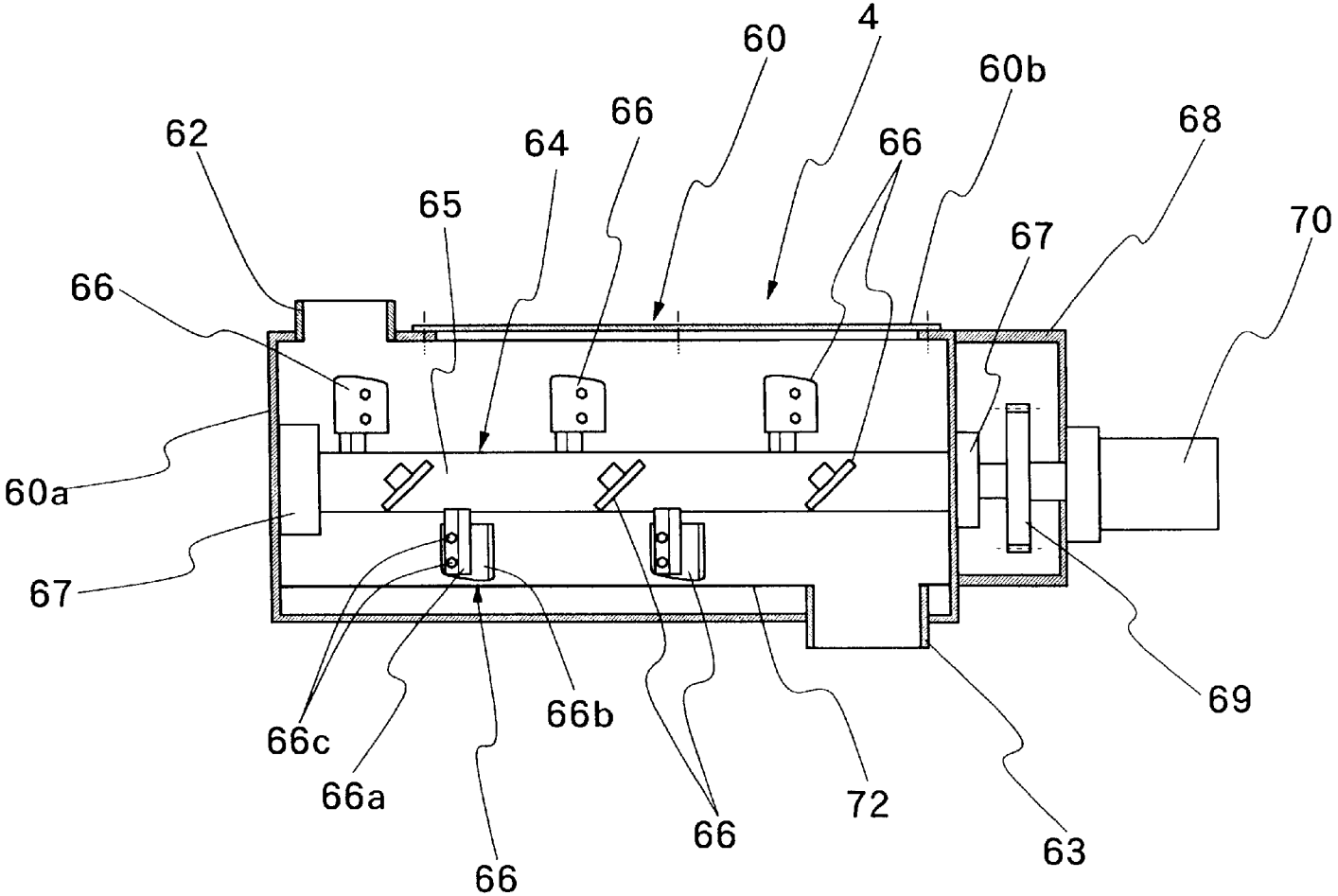
FIG. 14 is a sectional view taken on line Y—Y of FIG. 13.
Figure 15:
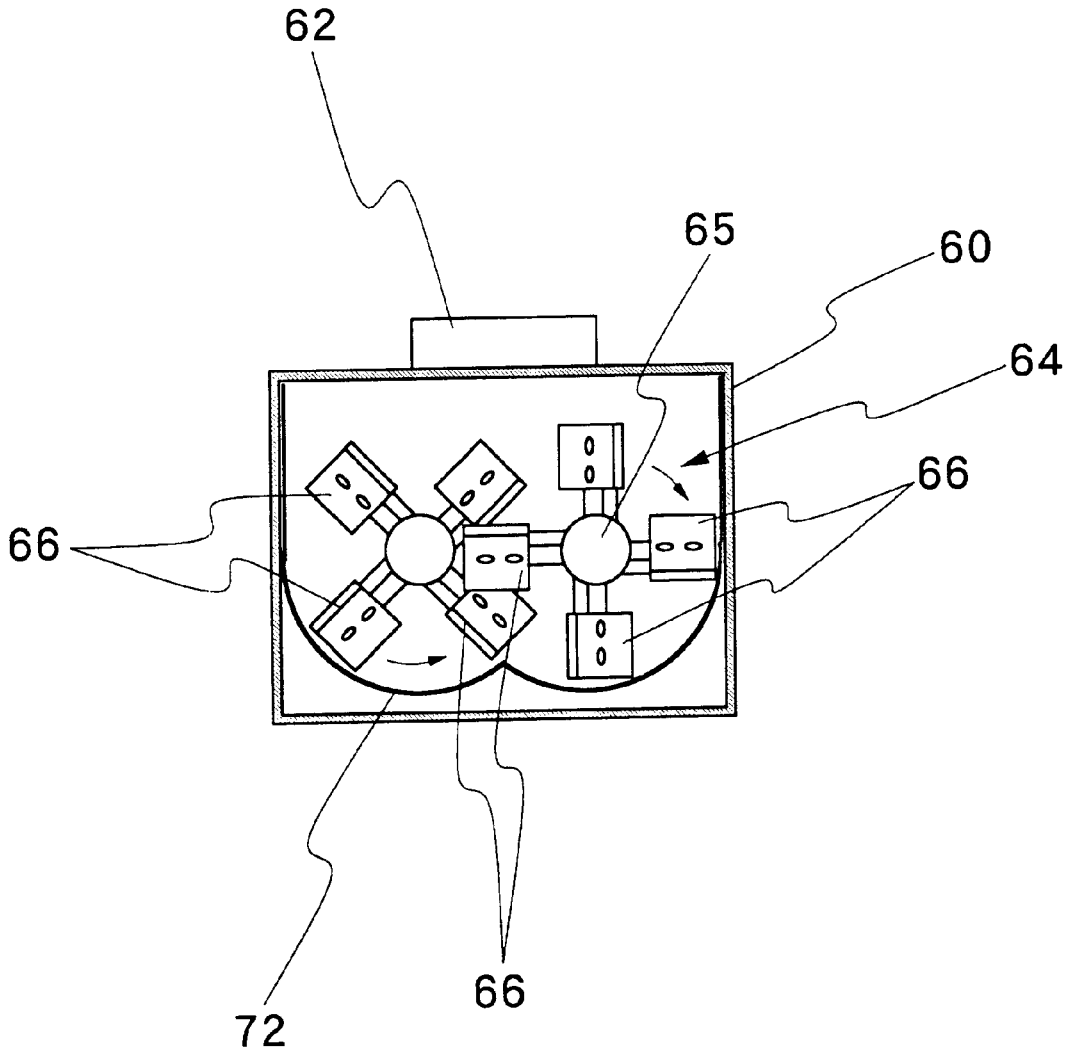
FIG. 15 is a sectional view taken on line Z—Z of FIG. 13.

Referring to FIGS. 12 to 15, there is shown the internal construction of the soil processing trough 60 of the processing stage 4. As seen clearly in FIG. 12, the soil processing trough 60 is in the form of a rectangular box-like container which is substantially horizontally mounted on the main truck frame 2 to extend in the longitudinal direction of the latter. The soil processing trough 60 is provided with swing doors 61 on its outer lateral side. Further, the soil processing trough 60 is provided with an inlet frame 62 hedging an inlet opening on the upper side of its front end portion, and an outlet frame 63 hedging an outlet opening on the bottom side of its rear end portion. As shown in FIGS. 13 to 15, a couple of paddle mixers 64 are extended through the soil processing trough 60 in parallel relation in the longitudinal direction. Each paddle mixer 64 is constituted by a rotational shaft 65, and a large number of paddles 66 which are intermittently planted on the rotational shaft 65 as agitating or mixing members at a predetermined angle with the longitudinal axis of the latter. In the particular embodiment shown, each paddle member 66 includes a support rod 66*a* which is securely fixed to the rotational shaft 65, and a paddle plate 66*b* which is fixed to the support rod 66*a* by bolts 66*c*. Accordingly, each paddle 66 can be easily replaced when worn out or damaged.

As soon as the rotational shafts 65 are put in rotation, the respective paddles 66 are turned around the rotational shafts 65 within the soil processing trough 60, so that the soil and the additive soil improving material which have been introduced into the processing trough 60 are tumbled and uniformly mixed with each other and at the same time transferred toward the outlet opening in a rear end portion of the trough 60. In the particular embodiment shown, the processing trough 60 is internally provided with a couple of paddle mixers 64. However, it is to be understood that the soil processing trough 60 may be provided with a larger or smaller number of paddle mixers or mixer depending upon its dimensions in width and height. In case the soil processing trough 60 is increased in height, for example, it may employ a smaller number of paddle mixer or mixers of a larger size having a larger radius of rotation. On the other hand, in case the soil processing trough 60 is of a shape which is smaller in height but larger in width, it is preferred to employ a larger number of paddle mixers side by side in the transverse direction. Accordingly, the number of the paddle mixers 64 which can attain the highest mixing efficiency is determined in relation with the size of the soil processing trough 60 which is in turn determined by the width of the main truck frame 2 and the height of the machine as a whole. However, in order to mix and transfer soil and additive soil improving material within the soil processing trough 60 smoothly in an efficient manner, there should be provided an even number of paddle mixers 64 which are arranged to rotate in an opposite direction relative to each other.

The opposite ends of the rotational shaft 65 of each paddle mixer 64 are rotatably supported in bearings 67 and, as shown in FIG. 13, the fore end of the rotational shaft 65 is extended into a housing of a trough drive section 68 which is provided adjacently at the front end of the soil processing trough 60. Mounted on front end portions of the respective rotational shafts 65 are transmission gears 69 which are meshed with each other. One of the transmission gears 69 is meshed with a drive gear 71 which is mounted on an output shaft of a hydraulic motor 70. Accordingly, upon rotationally actuating the hydraulic motor 70, the respective rotational shafts 65 which carry the paddles 66 are rotated simultaneously in opposite directions. Further, attached to the bottom of the soil processing trough 60 is a guide plate 72 thereby to prevent soil and additive soil improving material from stagnating in lower corner portions of the processing trough 60. The guide plate 72 is provided with a perforation in its rear end portion to receive the outlet frame 63 of the processing trough 60.

The paddles 66 are provided along the entire length of each one of the rotational shafts 65 of the paddle mixers 64s, which is disposed in a mixing zone between the inlet and outlet frames 62 and 63 of the soil processing trough 60. Accordingly, the bearings 67 which support the opposite ends of the rotational shafts 65 are mounted in positions anterior to the inlet frame 62 but posterior to the outlet frame 63. As a consequence, soil and additive soil improving material which are supplied through the inlet frame 62 are mixed with each other smoothly in an assured manner while being transferred at a constant speed toward the outlet frame 63 at the rear end of the processing trough.

As a result of the mixing operation of the paddle mixers 64 which mix the additive soil improving material uniformly into excavated soil within the soil processing trough 60, improved soil which consists of a uniform mixture of excavated soil and the soil improving material is produced and discharged through the outlet frame 63 of the trough 60. The improved soil is dropped by gravity onto a discharging conveyer 73 which is located beneath the outlet frame 63. In this instance, the soil receiving end of the discharging conveyer 73 is located in a lower position than the outlet frame 63 which is provided on the lower side the soil processing trough 60. The discharging conveyer 73 is set in a sloped position, rising obliquely upward toward the other delivering end. This is because it will become difficult to pile up the treated soil into a large heap if the conveyer is set in a horizontal position.

In case lime is used as a soil improving material, the product soil which consists of a uniform mixture of soil and additive soil improving material comes out in nodulized forms. In order to transfer the improved soil product smoothly in an obliquely upward direction by the discharging conveyer 72, the angle of inclination of the conveyer is limited to a certain range. This means that, for piling up the improved soil product, the length of the soil discharging conveyer 73 has to be elongated to some extent. In this regard, the total length of the soil treating machine can be reduced by making a rear or outer end portion of the discharging conveyer 73 foldable. In so doing, the discharging conveyer 73 should be arranged to have a folding point at a position which is lower than the highest point of the soil treating machine as a whole, more specifically, at a position lower than the upper end of the additive hopper 30. Accordingly, the soil discharging conveyer 73 is constituted by a fixed conveyer portion 73*a* which is fixedly supported on the main truck frame and extended out in an obliquely upward direction from beneath the soil processing trough 60, and a foldable conveyer portion 73*b* which is pivotally connected to the upper end of the fixed conveyer portion 73*a* through a link mechanism 74 and foldable in the arrowed direction in FIG. 1. Thus, the foldable conveyer portion 73 is driven by a hydraulic cylinder or other suitable drive means to and from an operating position indicated by a solid line and a folded position indicated in phantom.

Figure 16:
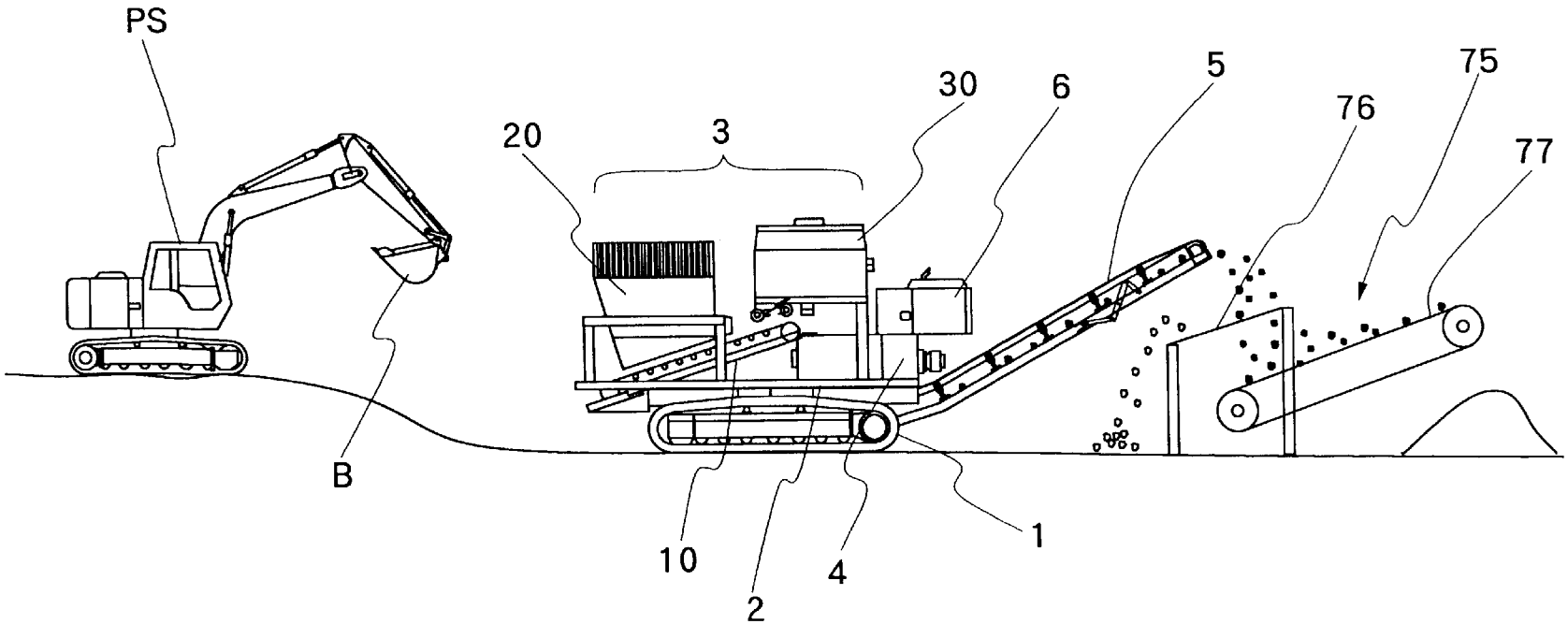
FIG. 16 is a schematic illustration of the soil treating machine in a soil treating operation within a yard.

Shown schematically in FIG. 16 is a soil improving operation in a soil treating yard of a small scale, using the vehicular soil treating machine of the above-described construction. In the yard, there is a heap or heaps of untreated soil which had been collected beforehand. Firstly, untreated soil is thrown into the soil hopper 20 of the machine to start a soil treating operation. For this purpose, a hydraulic power shovel PS can be used as means for throwing untreated soil into the soil hopper. Accordingly, a heap of collected soil on a yard can be processed into a product of improved quality by the use of the vehicular soil treating machine and the hydraulic power shovel PS.

For treating soil which is heaped over certain areas of the yard, untreated soil is scooped up by a bucket of the hydraulic power shovel successively from one end of the hand thrown into the soil hopper 20 of the soil treating machine. While soil from the hopper 20 is being transferred by the feeder conveyer 10, an additive soil improving material is supplied from the additive hopper 30 and poured on surfaces of the soil on the conveyer 10. At the inner end of the feeder conveyer 10, the soil and additive soil improving material are dropped into the soil processing trough 60 through the inlet frame 62 of the processing trough, and uniformly mixed with each other by the mixing actions of the paddle mixers 64 while being transferred toward the outlet frame 63 of the processing trough 20. Consequently, produced at the outlet of the soil processing trough 60 is a soil product, for example, of a nodulized form, which is improved in quality and consisting of a uniform mixture of excavated soil and additive soil improving material. The improved soil product which comes out through the outlet frame 63 is heaped up at a predetermined place on the yard by the discharging conveyer 73.

With progress of the soil treating operation, the heap of untreated soil on the yard is gradually consumed to open up a space which can be used for piling the improved soil product. Therefore, most of the spaces in the soil treating yard can be used as a depository place for both untreated soil which has been collected from ground work sites and for improved soil which is continuously produced by the soil treating operation. This is an ideally effective use of limited yard spaces, and made possible by the use of the vehicular soil treating machine with the base carrier 1. By operating the base carrier 1, the soil treating machine can be moved on the yard in step with regressions of depository areas of untreated soil.

In piling up treated soil on the yard, all the improved soil product which comes out on the discharging conveyer 73 may be deposited in one predetermined place on the yard. However, in some cases it is desirable to classify the improved soil product according to grain size. For this purpose, a sorting mechanism 75 is added as shown in FIG. 16. In this case, the sorting mechanism 75 is of a portable type and largely constituted by a sieve 76 and a conveyer 77. The sieve 76 is of a predetermined mesh size and preferably vibrated to pass grains which are smaller than a predetermined size, for example, smaller than 13 mm, 20 mm or 25 mm. The improved soil of a grain size which can pass through the sieve 76 is further transferred by the conveyer 77 and piled in a predetermined depository place. The improved soil of a larger grain size which cannot pass through the sieve 76 is also improved in quality by the coagulative hardening process, and therefore can be used as a foundational refill as it is or after a further classification in grain size.

In order to improve the quality of the soil product, it is desirable to remove rocks, fragments of bricks or concrete as well as metallic or other foreign matter from untreated soil in a preparatory stage. As described hereinbefore, the sieve means 21 of the soil hopper 20 is provided for this purpose. By screening actions of the sieve means 21, substantially soil alone is fed into the soil hopper 20, while foreign matter which cannot pass through the sieve means 21 is caused to slide down along the inclined top surface of the sieve means, thereby precluding the possibilities of foreign matter blocking the soil charging operation.

Nextly, the mixing ratio of soil to additive soil improving material is adjusted accurately to maintain the degree of consolidation of soil in a predetermined range. In this respect, consolidative effects of an additive soil improving material vary depending upon the properties of soil to be treated. Accordingly, it is desirable to determine the most desirable mixing ratio by prior experiments. The mixing ratio of soil to additive material may be either a ratio by volume or a ratio by weight. Nevertheless, it is preferable to determine a weight ratio, taking influential factors such as soil density and viscosity into consideration.

The soil feed measuring means 60 is adapted to measure the weight of soil which is supplied from the soil hopper 20. This soil feed measuring means 50 is arranged to directly detect the weight of soil which is transferred the feeder conveyer 10, from the load which is exerted on the weight measuring roller 52. Regarding the additive soil improving material, it is suppled to the feeder conveyer 10 from the additive hopper 30 at a position downstream of the soil feed measuring means 50. The feed rate of the additive material can be adjusted by varying the rotational speed of the quantitative feeder 42 of the quantitative feed section 32. Accordingly, the electric motor 46 is controlled according to a signal from the load sensor 55 adjusting rotational speed of the quantitative feeder 42 and varying the feed rate of the additive soil improving material in such a way as to maintain a predetermined mixing ratio even if there were fluctuations in soil feed rate by the feeder conveyer 10.

The quality of a treated soil product greatly depends upon to what degree soil and additive material are mixed with each other within the soil processing trough 60. In this regard, the soil processing trough 60 which is internally provided with the paddle mixers 64 can mix soil and additive soil improving material uniformly to a sufficient degree. In the particular embodiment shown, the processing trough 60 is provided with a couple of paddle mixers 64 which are arranged to rotate in opposite directions as indicated by arrows in FIG. 15. Therefore, within the soil processing trough 60, the charged soil and additive soil improving material are incessantly tumbled up and down and chopped into pieces substantially in every part within the entire length of the trough by shearing and mixing actions of the turning paddles 66 which are attached to the rotational shafts 65 of the paddle mixers 64, and as a result formed into a uniform mixture. At the same time, the mixture of soil and additive soil improving material under the mixing actions of the paddles 66 are transferred forward substantially in the horizontal direction toward the outlet frame 63 of the trough 60 since the respective paddles 66 are attached obliquely relative to the axes of the rotational shafts 65. Besides, the mixture of soil and additive material are transferred smoothly at a constant speed since there are no obstacles like bearings between the inlet frame 62 and outlet frame 63 of the soil processing trough 60. As a consequence, soil of very inferior quality can be processed into a soil product with a quality suitable for an intended purpose of use. Further, except the inlet and outlet frames 62 and 63, the soil processing trough 60 is arranged to treat soil in a substantially closed space, precluding the possibilities of soil and additive material scattering around while undergoing agitating and mixing actions of the paddles 66.

Soil and additive soil improving material should be retained in the processing trough 60 for a time length which is necessary for the paddles 66 of the paddle mixers 64 to shear soil and to mix soil and additive soil improving material to a sufficient degree and in an efficient manner. In this regard, since soil and additive soil improving material are transferred through the processing trough 60 substantially in the horizontal direction, a sufficient residence time can be secured, for example, by increasing the length of the processing trough 60 or by setting a suitable transfer speed through adjustments of inclination angle of the mixing paddles 66, without increasing in particular the height of the processing trough 60.

The efficiency of shearing and mixing actions of the mixing paddles 66 can be lowered in case soil sticks to the paddle surfaces. In this regard, the paddles 66 of one of the paddle mixers 64 are extended between the paddles 66 of the other paddle mixer 64, in such a way that the paddles 66 of the two paddle mixers 64 are turned substantially in alternately overlapped positions when seen in the axial direction of the rotational axes 65. Therefore, the soil which has stuck on surfaces of the paddles 66 of one paddle mixer 64 in operation is scraped off by the paddles 66 of the other paddle mixer 64 which are in rotation in the opposite direction. Therefore, due to this self-cleaning action, the paddles 66 are less unsusceptible to degradations in mixing efficiency as caused by sticking soil.

Further, subsequent to a soil processing or treating operation, the lid 60*b* can be removed to open up the top side of the trough body 60*a* or the side doors 61 on a lateral side of the trough body 60*a* can be opened wide, so that sticking soil, if any, can be removed from the paddles 66 in an extremely facilitated manner. This arrangement also permits easy maintenance of the processing trough 60. Namely, the paddles 66 can be retained in smoothly and efficiently operative conditions by carrying out maintenance and service of this sort at a suitable frequency. When the paddles 66 have worn out by frictional contact with soil after use over an extended period of time, worn-out paddle portions 66*b* can be easily replaced by removing the bolts 66*c*.

In case untreated soil to be supplied to the soil processing trough 60 is of low viscosity, it should be retained in the processing trough 60 for as long a time period as possible in moderately agitated conditions for the purpose of encouraging reactions between soil and additive soil improving material. Accordingly, at the time of treating soil of low viscosity, the paddle mixers 64 should preferably rotated at a lower speed. In contrast, soil of high viscosity would tend to entangle around the paddles 66 to hinder the rotation of the paddle mixers 64 and, in, a worse case, could bring the paddle mixers 64 into a locked state. Therefore, for treatment of soil of higher viscosity, the paddle mixers 64 should be rotated at a higher speed.

As described hereinbefore, the soil which is dropped on the feeder conveyer 10 through the soil hopper 20 is substantially leveled into a uniform thickness or height by the gate 23 and leveling roller 24. Besides, the weight of feed soil on the feeder conveyer 10 is detected by the soil feed measuring means 50. It follows that the bulk density of feed soil can be known from weight signals from the soil feed measuring means 50. As long as feed soil is same in property, a higher bulk density reflects a higher viscosity. Therefore, on the basis of weight signals from the soil feed measuring means 50, the hydraulic motor 70 which drives the paddle mixers 64 can be controlled to rotate at a higher speed when feed soil is of high viscosity and to rotate at a lower speed when feed soil is of low viscosity.

Figure 17:
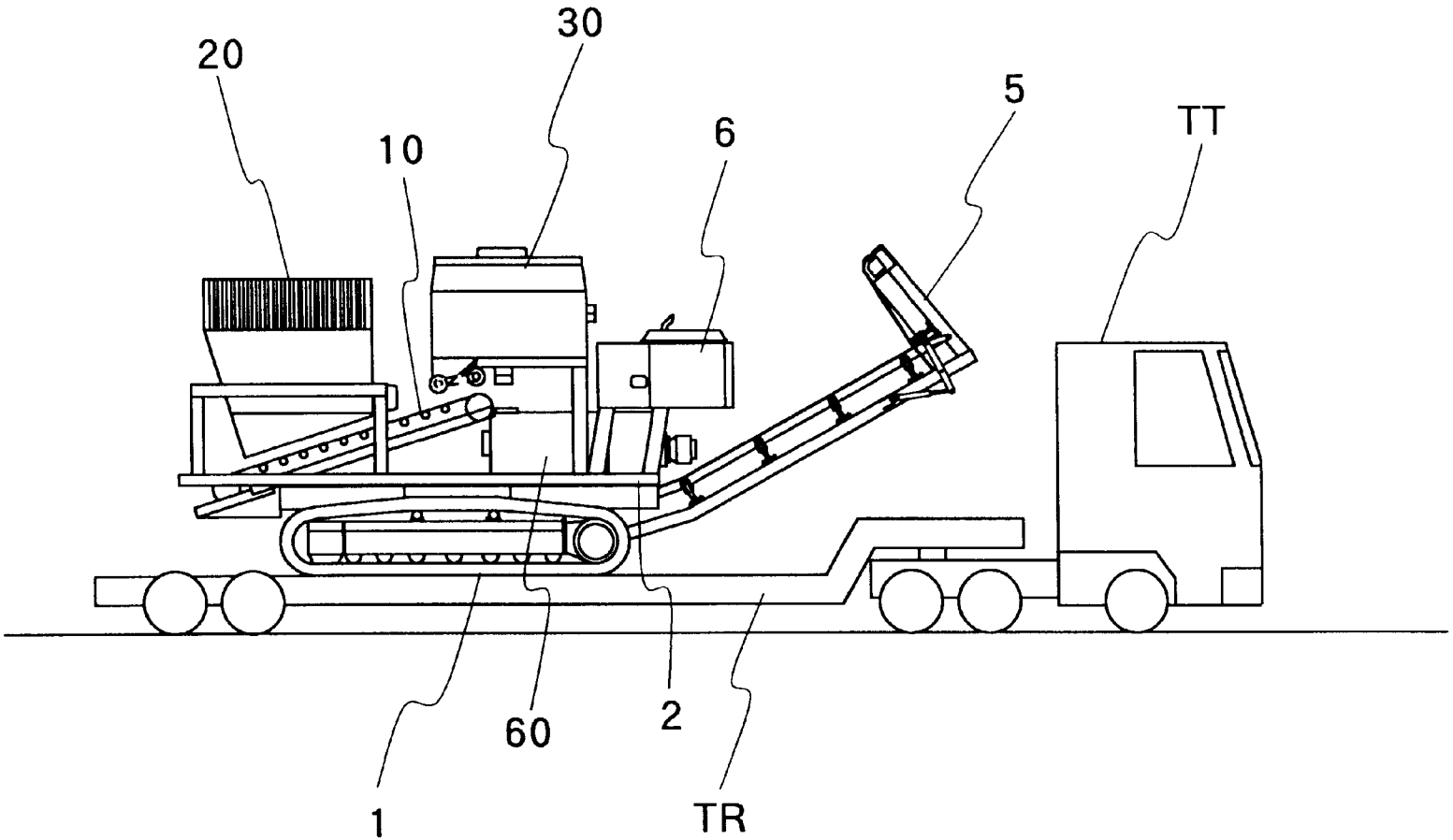
FIG. 17 is a schematic illustration of the soil treating machine being transferred by a trailer tractor.

Since the soil treating machine is constructed for common use by a plural number of yards, it is transported from one soil treating yard to another after finishing a soil treating operation for a relatively small amount of soil in one yard. For this purpose, as shown in FIG. 17, the soil treating machine is transported on a trailer car TR which is dragged by a trailer tractor TT. A freight to be transported by the trailer tractor TT of this sort is subject to dimensional restrictions, particularly restrictions in length, width and height. Most importantly, a machine to be transported by the trailer should small enough in height since otherwise the route of transportation would have to be limited to those roads which are clear of tunnels, overhead bridges or similar obstacles. Part of the machine can be disassembled prior to transportation by the trailer tractor TT. In such a case, however, the machine has to be disassembled and reassembled on transportation to one soil treating yard to another, although these jobs are extremely troublesome and time-consuming.

The height of the soil treating machine is determined, in most cases depending upon the position in height of the soil inlet frame 62 through which soil and additive soil improving material enter the processing trough 60 which constitutes the major part of the soil treating mechanism. As described hereinbefore, while being agitated and mixed with each other, the charged soil and additive soil improving material are transferred through the processing trough 60 substantially in the horizontal direction. Therefore, for an efficient soil treating operation, the volume of the trough can be enlarged without increasing its height. Of course, the feeder conveyer 10 which delivers soil and additive soil improving material should have its transfer surface of its carrier belt 11 located at a higher position than the soil processing trough 60. Further, since soil and additive material are dropped or supplied through the hoppers 20 and 30, respectively, which are largely projected above the transfer surface of the carrier belt 11. However, since the soil processing trough 60 is limited and reduced in height in this case, the positions of the hoppers 20 and 30 are lowered to the same extent. In addition, since the feeder conveyer 10 is set in an inclined state, the soil hopper 20 can be located in a position which is further lowered in height. In order to reduce the frequency of replenishment to the hopper 30 of the soil improving material which is consumed during a soil treating operation, the hopper should have as large a storage capacity as possible. The hopper 30 needs to have a sufficient volume for this purpose and yet it is located at the highest position as seen in FIG. 1. However, since the additive material feed port 41 is opened over a sloped portion of the carrier belt 11 of the feeder conveyer 10, the position of the additive hopper 30 can be lowered to a corresponding degree. Further, the upper end of the discharging conveyer 73, which is foldable in an upper end portion, can be folded to a position lower than the upper end of the additive hopper 30.

Moreover, the machine chamber 6 is located in a vacant space which is available over the soil processing trough 60 behind the additive hopper 30 and forward of the discharging conveyer 73. Besides, the soil hopper 20 and additive hopper 30 are located close to each other, and the machine chamber 6 is also located close to the additive hopper 30. Therefore, the discharging conveyer 73 can be folded in toward the vacant space to reduce the height of the sol treating machine as a whole.

Accordingly, the soil treating machine can be downsized into a compact form and especially can be reduced in height so that it can be transported easily and smoothly from yard to yard by a trailer tractor TT without being disassembled into a number of pieces. At the time of transportation, the vehicular soil treating machine can get on and off the trailer TR by its own automotive drive in a smooth and quick manner. In addition, despite the compactness in construction, the machine can efficiently mix soil and additive soil improving material within the processing trough 60 to produce a soil product of high quality on a large scale and at a high production rate.

Figure 18:
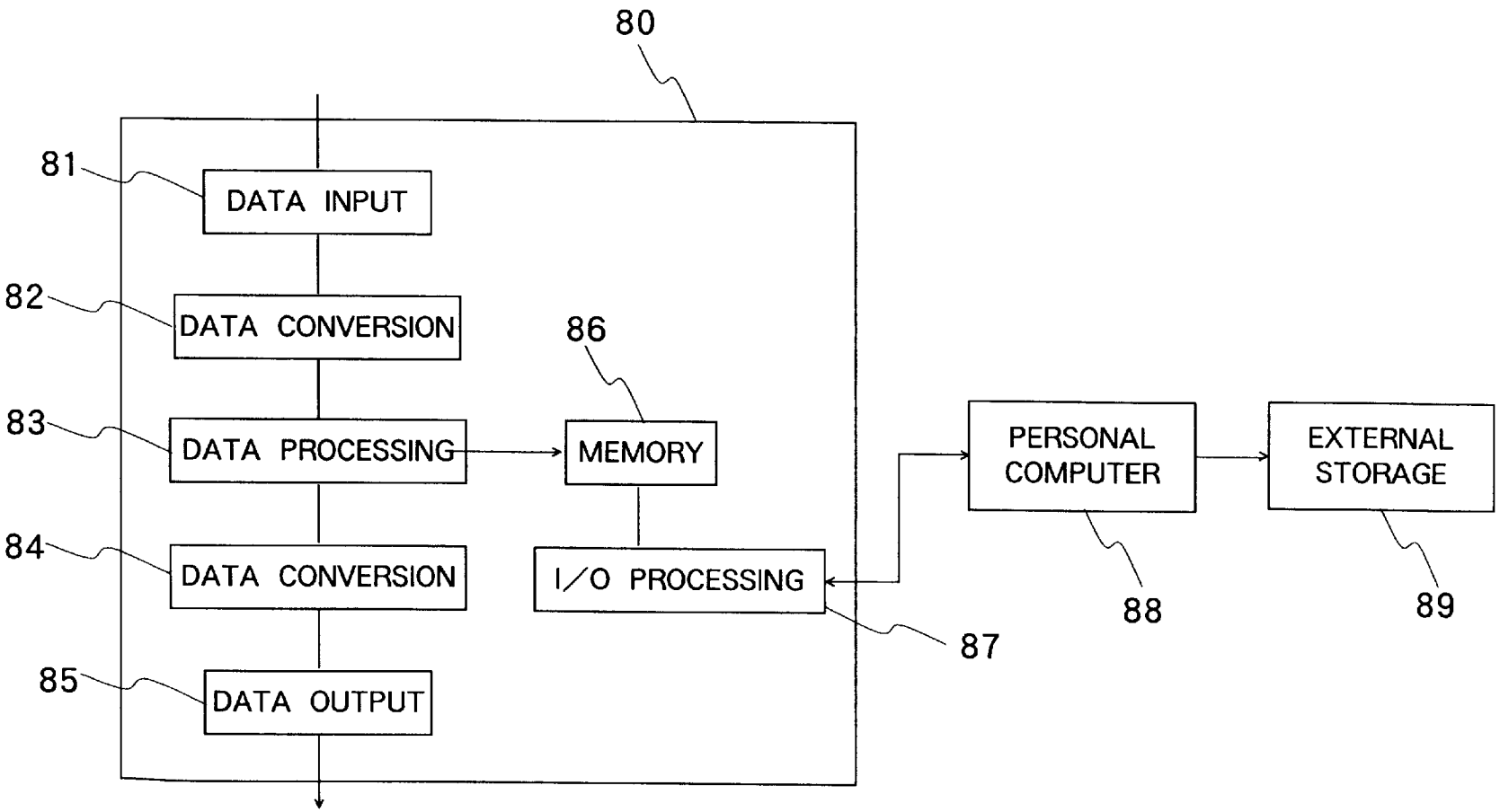
FIG. 18 is a block diagram of a control system employed for the soil treating machine.

Referring to FIG. 18, there is diagrammatically shown a controller 80 which is employed for controlling operations of the soil treating machine as a whole. This controller 80 produces control signals to various operating parts of the machine, on the basis of signals from sensors and detectors which constitute the machine. More specifically, the controller 80 includes a data input section 81 for processing various input signals, a data converting section 82 for signal amplification and A/D conversion, and a data processing section 83 for performing predetermined arithmetic operations and signal processing according to input data. On the basis of signals processed at the data processing section 83, the controller produces control signals for controlling operating parts such as hydraulic actuators and control valves. The control signals are supplied to the operating parts from a data output section 85 after D/A conversion at a data converting section 84.

Accordingly, a signal from the load sensor 55 which constitutes the soil feed measuring means 50 is processed at the controller 80 according to a preset mixing ratio to produce a control signal for the electric motor 46 which drives the quantitative feeder 42 of the quantitative feed section 32 of the additive hopper 30 to adjust the feed rate of the additive soil improving material from the quantitative feed section 32. Simultaneously, the controller 80 produces a control signal for the hydraulic motor 70 which drives the paddle mixers 64 of the soil processing trough 60 to control the rotational speed of the paddle mixers 64 according to the signal from the load sensor 55.

Various operating data of a soil treating operation are stored in an internal memory 86, the contents of which are downloaded, for example, to a personal computer 88 through I/O processor 87 and thereby compiled according to predetermined algorithm. Compiled data are stored in an external storage 89 which is connected to the personal computer 88. In this manner, various data of each soil treating operation are fed to the personal computer 88 for storage and management purposes.

In this regard, in order to enhance reliability of soil treatment, it is desirable to store operational data in the order of steps taken in each soil treating process or in other appropriate form which can be analyzed afterwards in assessing the effects of a particular treatment rendered. Especially, it is necessary to store the data of the total amount of soil processed for a treatment, and of a mixing ratio to soil of an additive soil improving material used. The data of mixing ratio should be time-sequence data. For this purpose, the controller 80 is arranged to store in the memory 86 the data of output signals of the load sensor 55 of the soil feed measuring means 50 and of the rotational speed of the electric motor 45 of the quantitative feeder 42 on a time-sequence basis. This arrangement gives accurate data of the mixing ratio of the additive soil improving material to soil. Actually, improved soil is produced in the soil processing trough 60. In the soil processing trough 60, soil and additive soil improving material are mixed with each other and at the same time transferred by the mixing and feeding actions of the paddle mixers 64. In this regard, the controller should preferably be arranged to vary the rotational speed of the paddle mixers 64 in relation with viscosity of processing soil. Therefore, the controller is arranged to take in data of the rotational speed of the paddle mixers 64 as well, for recording all of these operating factors of each soil treatment.

Upon finishing a soil treating operation, these operational data can be downloaded to the personal computer 88 which is connected to the I/O processing section 87 of the controller. As mentioned hereinbefore, processed and complied operational data can be stored in the external storage device 89 which is connected to the personal computer 88, for example, on a non-volatile data recording means such as a flexible magnetic disk, photomagnetic disk, memory card or the like, for later use in analyzing and assessing operational conditions in relation with quality of treated soil.

The soil processing trough 60 is limited in length. Nevertheless, soil and additive soil improving material has to be uniformly mixed while being transferred through the length of the soil processing trough 60 from the inlet 62 to the outlet 63. In this regard, the vehicular soil treating machine of the present invention, which is intended for use on small-scale soil treating yards, should be able to make small turns when moved around on a yard, and at the same time should be compact in construction and small in size to facilitate its transportation from one yard to another. The size of the soil processing trough, particularly, the length of the soil processing trough, which occupies a dominant part of the soil treating machine, has a great influence on the size of the machine as a whole. Of course, the soil processing trough 60 should not be downsized into a compact form at the sacrifice of its soil treating capacity or efficiency.

In consideration of the foregoing points, the top priority should be given to the quality of treated soil, in other words, to the capability of mixing soil and additive soil improving material to a satisfactory degree. Withing a tolerable range in quality, the length of the soil treating machine should be reduced in such a way as to enhance its soil treating efficiency. In this regard, a study has been made on the relationship between the construction of the paddle mixers 64 and the mixing efficiency. Each paddle mixer 64 has a plural number of paddles 66 attached on the circumference of the rotational shaft 65. In order to feed the contents of the processing trough 60 while mixing same, the paddles 66 are located in helically shifted positions around the circumference of the rotational shaft 65.

Figure 19:
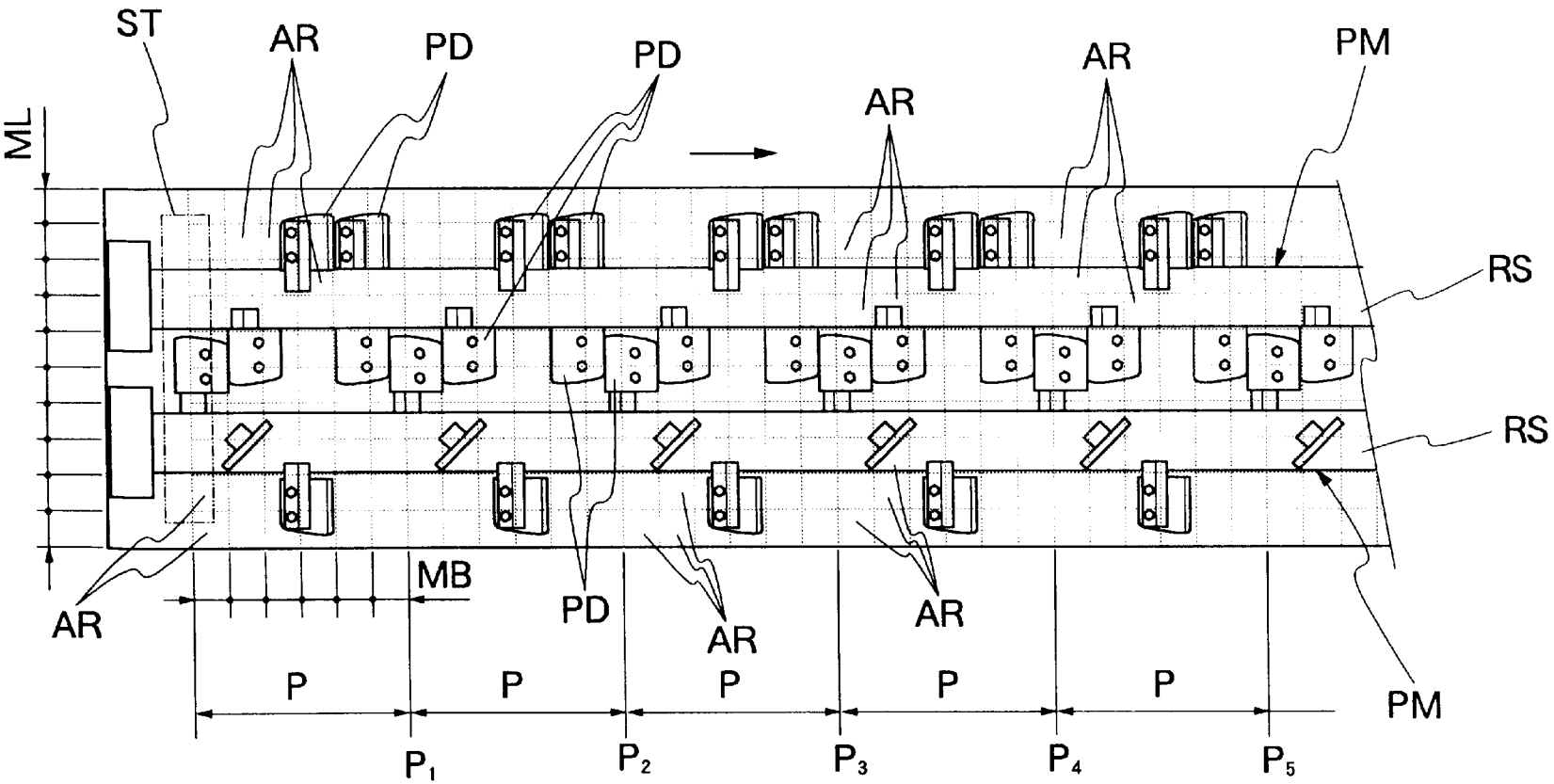
FIG. 19 is a diagrammatic illustration explanatory of relations between paddle pitch of a paddle mixer and mixing effects on soil and additive soil improving material within the soil processing trough.

In the particular embodiment shown in FIG. 19, paddles PD in a helical row around a rotational shaft RS of a paddle mixer PM are angularly shifted from each other by 90 degrees. Accordingly, the interval between paddles PD in every fourth position in the helical row determines an axial paddle pitch P. The positions of the paddles PD on the rotational shafts RS of the two paddle mixers PM are axially shifted from each other by ¼ of the paddle pitch P. Accordingly, the paddles PD which are mounted the two adjacently located rotational shafts RS face toward each other in small gap relation and at axially spaced positions corresponding to the paddle pitch P. As a result, when seen in the axial direction of the rotational shafts RS or in the transfer direction of the paddle mixer PM, the paddles PD on the two rotational shafts RS come into an overlapped state at paddle pitch positions and spaced away from each other at intermediate positions.

Upon actuating the paddle mixer PM, processing material on the outer side of the rotational shafts RS within the processing trough 60 is scooped and tossed up in those regions where the paddles PD of the two rotational shafts RS are moved away from each other, and the upwardly tossed portions of the material are then pushed downward to join at the space between the two rotational shafts RS as the paddles PD are in movement toward each other. When the processing material is moved downward, it is mixed by the action of the paddles PD which are moving toward the overlapping positions and acting on the processing material from opposite sides thereof. Namely, from the standpoint of mixing efficiency, the material under treatment is mixed most efficiently at center portions where paddles PD of the two rotational shafts come to overlapping positions.

The degree of mixing at various parts of the processing trough was measured after charging processing material into the processing trough and mixing same by the paddle mixer PM over a predetermined distance of transfer in the direction indicated by an arrow in FIG. 19, starting from an initial charging position ST. As soon as the charged material reached a predetermined stop position, the paddle mixer PM was deactuated to measure the degree of mixing at various positions. For measurement purposes, a sectional area of the processing trough was divided into a large number of small sampling areas AR in the fashion of a checkerboard, divided at intervals MB of predetermined breadth in the transfer direction and at intervals ML similarly of predetermined breadth in a direction perpendicular to the transfer direction. Processing material was sampled from each one of small sampling areas AR in the transverse rows which were divided at the intervals MB to measure the differences in content of an additive soil improving material. The results of this measurement are shown in FIG. 20, in which the vertical axis represents the degree of mixing, the horizontal axis represents the length of the processing trough, and reference characters $P_1$, $P_2$, $P_{2.5}$, $P_3$, $P_4$ and $P_5$ are paddle pitches.

Figure 20:
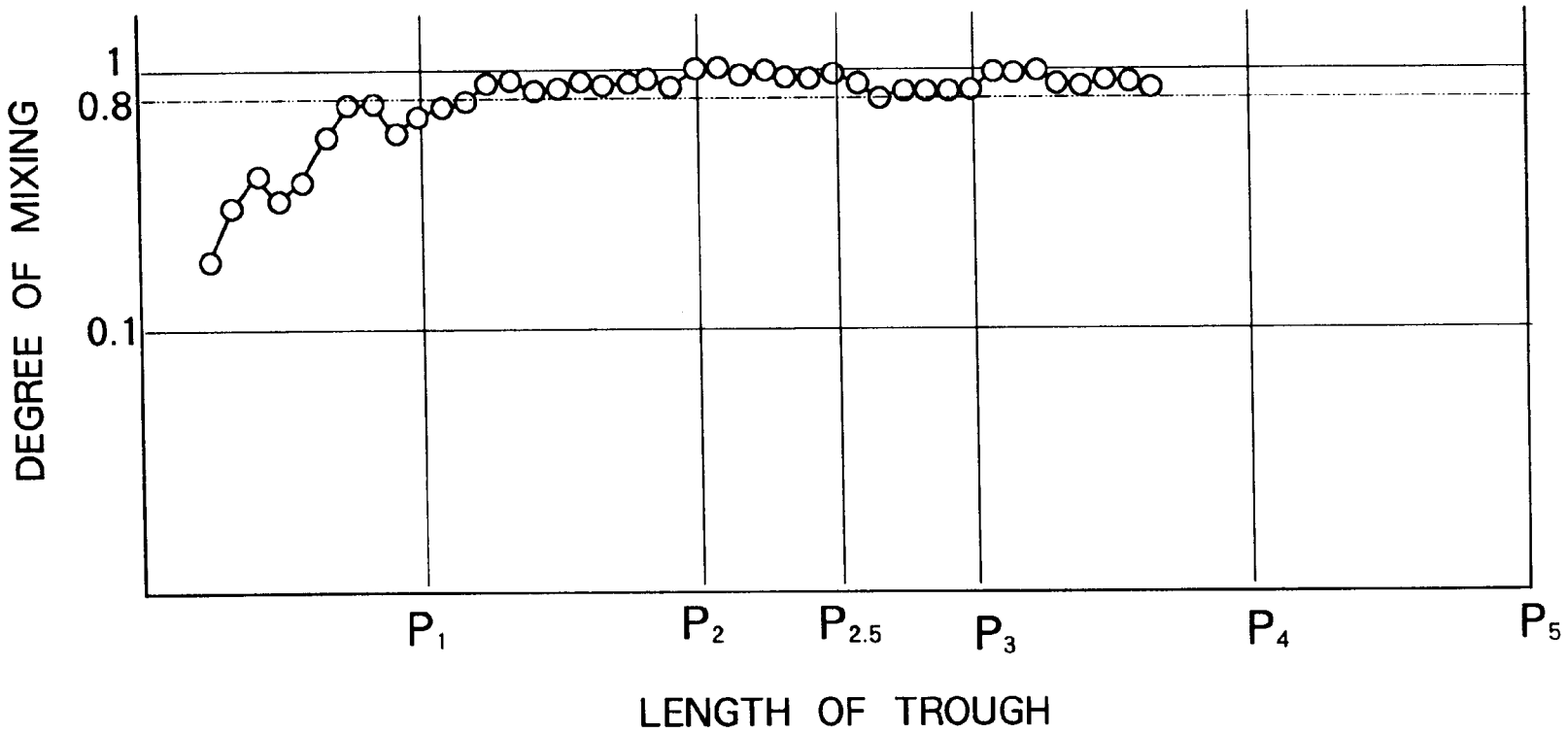
FIG. 20 is a diagram showing mixing effects on soil and additive soil improving material in the longitudinal direction of the soil processing trough in FIG. 19.

As seen particularly in FIG. 20, in case the paddle pitch of the paddle mixer PM is 2.5, the degree of mixing falls in the range of 0.8 to 1, that is to say, all of the small sampling areas AR in a row in the transverse direction of the trough show almost a uniform value in content of the additive soil improving material. Even if the paddle pitch is further increased, substantially no improvements in the degree of mixing are observed.

From the foregoing experimental results, it has been confirmed that soil and additive soil improving material can be mixed uniformly to a practically sufficient degree by a paddle mixer of a minimum length when the processing material transfer distance of the paddle mixer is more than 2.5 times as large as the paddle pitch, and preferably more than 3 times as large as the paddle pitch, taking variations in soil property into consideration. Accordingly, paddles 66 are arranged in three cycles around each one of the rotational shafts 65 of the paddle mixer. Namely, the distance between the inlet 62 and the outlet 63 of the processing trough 60 is arranged to be approximately three times as large as the paddle pitch P. This arrangement provides the minimum length for the processing trough 60 to be able to mix soil and additive soil improving material uniformly to a sufficient degree. In addition, from the standpoint of processing efficiency of the trough 60, the outside diameter of the paddles 66 is preferred to be approximately equivalent with the paddle pitch P. In short, in the most compact form of the processing trough 60 which can mix soil and additive soil improving material with satisfactory efficiency, the total length of the processing trough 60 is three times as large as the paddle pitch P and at the same time three times as large as the outside diameter of the paddles 66. By this arrangement, the processing trough 60 can be reduced to a minimum in length, namely, can be downsized into a compact shape as a whole. Therefore, it becomes possible to reduce the total length of the soil treating machine, permitting same to make small turns easily and making it transportation convenient.

Regarding the mixing efficiency within the processing trough 60, it varies depending upon the nature of processing soil. Uniform mixing of processing material may become difficult when the length of the processing trough 60 is reduced as described hereinbefore. Especially in a case where processing soil has a large moisture content, its viscosity could be increased correspondingly to make it difficult to mix an additive material uniformly into processing soil. On the contrary, if the moisture content is extremely small, difficulties may be encountered in keeping a stabilized mixing operation and also in getting sufficient reactions between soil and additive material for producing soil product of nodular construction particularly when lime is used as an additive soil improving material. Therefore, in order to carry out a soil improving process stably and precisely within the processing trough 60, it is necessary to adjust the moisture content in processing soil to some extent. In this regard, preferably the moisture content in processing soil should not exceed 40% but should be larger than 30%, inclusive. Therefore, the moisture content in processing soil is adjusted prior to throwing same into the processing trough 60. More particularly, in case the moisture content in processing soil is greater than 40%, it is adjusted to a percentage smaller than 40% by mixing dry soil or lime thereinto. On the other hand, in case the moisture content in processing soil is smaller than 30%, it is increased by sprinkling water before charging the soil into the processing trough.

Figure 21:
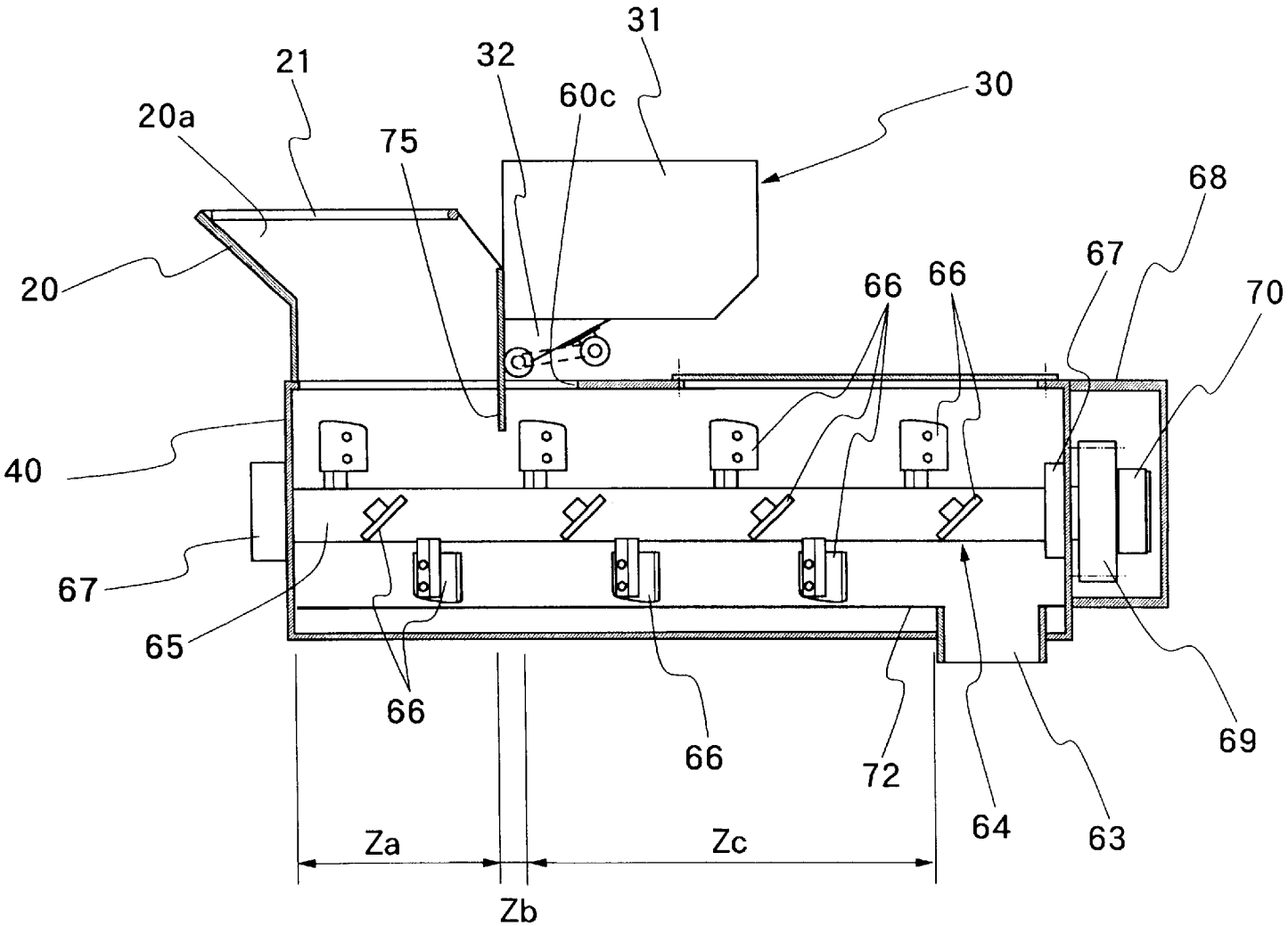
FIG. 21 is a schematic sectional view of soil and additive feed sections and a mixing mechanism in a soil processing stage of a soil treating machine in another embodiment of the present invention.

In the foregoing embodiment, in order to maintain a constant mixing ratio of an additive material to processing soil, the soil hopper 20 and the quantitative feeder 42 of the additive hopper 30 are opened over the feeder conveyer 50 which is provided with the soil feed measuring means 50. In this regard, FIG. 21 shows an alternative arrangement which is also capable of accurately controlling the mixing ratio of an additive material to processing soil which is under treatment within the processing trough 60.

More specifically, in this instance, the processing trough 60 is provided with a large opening 60*c* in the ceiling of its front portion to function as an inlet opening for both soil and additive soil improving material. The soil hopper 20 is positioned forward of the processing trough 60, while the additive hopper 30 is positioned on the rear side of and at a predetermined distance from the soil hopper and has its quantitative feed section 32 opened toward the processing trough 60.

The displacement volume per revolution of the paddle mixers 64 in the soil processing trough 60 is determined by the number of paddle mixers 64 in the soil processing trough 60, and the number and working surfaces areas of the paddles 66 which are attached on the rotational shafts 65. Therefore, the soil feed rate is determined by the total displacement volume of the paddle mixers 64 as multiplied by rotational speed. On the other hand, the additive hopper 30 is provided with the quantitative feeder 42 the feed rate of which can be controlled by way of the electric motor 46. Accordingly, soil can be transferred through the soil processing trough 60 at a constant rate if the hydraulic motor 70, which drives the rotational shafts 65 of the paddle mixers 64 is put in rotation at a constant speed. For this purpose, soil is directly fed into the processing trough 60 at a constant rate from the soil hopper 20 which has a capacity of holding surplus soil, which has been thrown in beyond the soil transfer rate of the paddle mixers 64. Further, the processing trough 60 is provided with the gate 75 to limit the soil transfer rate. In this case, the soil feed rate is determined on the basis of the rotational speed of the hydraulic motor 70. For smooth and efficient soil mixing and transfer, it is desirable to locate the gate 75 in such a position as to cover approximately 20% or more of confronting paddle surfaces.

The lower open end of the quantitative feeder 42 of the additive hopper 30 is located on the downstream side of the gate 75. Namely, as shown in FIG. 21, in this case the processing trough includes three zones, i.e., a soil feed zone Za, an additive material feed zone Zb and a soil and additive material mixing zone Zc. With this processing trough arrangement, the mixing ratio of an additive soil improving material to processing soil can be controlled accurately by operating the hydraulic motor 70 and electric motor 46 constantly at predetermined speeds.

The rotational speed of the hydraulic motor 70 can be fluctuated due to variations in load conditions. For instance, load conditions of the hydraulic motor 70 which drives the paddle mixers 64 vary depending upon the amount of surplus soil which is stored in the soil hopper 20. Namely, the rotational speed of the hydraulic motor 70 is fluctuated by variations in the amount of soil stored in the soil hopper 20, which receives a soil supply intermittently. Besides, fluctuations in load condition of the hydraulic motor 70 are also caused by variations in resistance, that is, resistance of mixing material within the processing trough 60. Therefore, the additive feed rate from the additive feeder 42 to the processing trough 60 should be varied in such a manner as to follow variations which occur to the rotational speed of the hydraulic motor 70 under fluctuating load conditions. By varying the additive feed rate in this manner in relation with the soil transfer rate, the additive soil improving material is mixed into processing soil always at a constant rate because soil is continuously transferred through the processing trough 60 by the mixing and transferring operation of the paddle mixers 64. For this purpose, the rotational speed of the electric motor 46 is adjusted in such a way as to follow variations occurring to the rotational speed of the hydraulic motor 70.

Figure 22:
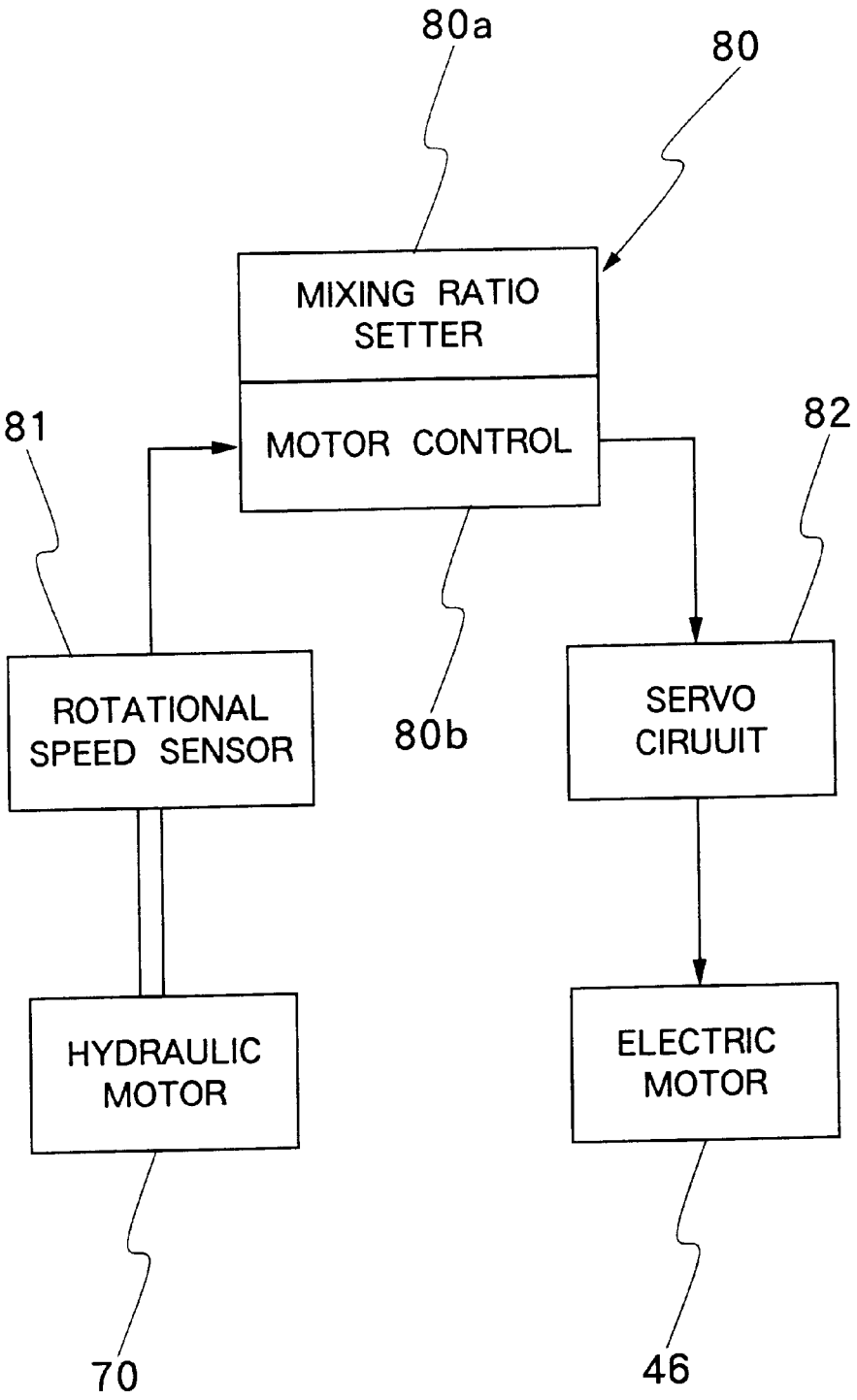
FIG. 22 is a block diagram of a controller employed in the embodiment of FIG. 21 for maintaining a constant mixing ratio.

Shown in FIG. 22 is a mixing ratio control means which is arranged to this effect, including a controller 80 which is provided with a mixing ratio setting section 80*a* and a motor control section 80*b*. The mixing ratio setting section 80*a* includes an input means for entering a suitable mixing ratio for an additive soil improving material to be mixed into processing soil. According to a mixing ratio entered at the mixing ratio setting section 80, a rotational speed ratio of the electric motor 46 to the hydraulic motor 70 is calculated by the controller. From a rotational speed sensor 81, the motor control section 80 receives a signal of rotational speed of the hydraulic motor 70, namely, of the paddle mixers 64. Since the soil transfer rate through the processing trough 60 depends on the rotational speed of the paddle mixers 64, that rotational signal is output as a control servo signal to a servo circuit 82 of the electric motor 46 which controls the additive feed rate of the quantitative feeder 42 of the additive hopper 30.

The additive feed rate by the quantitative feed section 32 of the additive hopper 30 is determined by the rotational speed of the electric motor 46 which drives the rotational shafts 43. Accordingly, in case the rotational speed of the hydraulic motor 70 is varied, namely, incase the soil transfer rate by the paddle mixers 64 is varied, the controller 80 calculates, on the basis of a signal from the rotational speed sensor 81, a rotational speed which is necessary for the electric motor 46 to maintain a predetermined mixing ratio of the additive soil improving material to processing soil, and the rotational speed of the electric motor 46 is varied by a signal from the controller in such a manner as to follow the variation in the rotational speed of the hydraulic motor 70. Consequently, despite variations in the rotational speed of the hydraulic motor 70, a predetermined mixing ratio is constantly maintained for processing soil and additive soil improving material.

What is claimed is:

1. An automotive soil treating machine, comprising:

a main frame mounted on a vehicular base carrier;

a first hopper provided on one longitudinal end of said main frame to receive soil to be processed;

a second hopper provided on said main frame in a position forward of said first hopper in a soil processing direction to receive a supply of an additive soil improving material;

a first conveyer provided on said main frame and adapted to receive soil and a soil improving material from said first and second hoppers and to transfer same forward in a longitudinal direction of said main frame;

a soil processing mechanism mounted on said main frame in a position forward of said first conveyer in said soil processing direction, and adapted to receive soil and additive soil improving material from said first and second hoppers and mix said soil and additive soil improving material uniformly with each other while transferring same substantially in a horizontal direction toward the other longitudinal end of said main frame;

a second conveyer provided on said the other longitudinal end of said main frame and adapted to transfer treated soil coming out of said soil processing mechanism further toward a predetermined dumping position; and a drive mechanism for said soil processing mechanism, supported on said main frame by means of a support member and at a position over said soil processing mechanism.

2. An automotive soil treating machine as defined in claim 1, wherein said first hopper is adapted to receive a supply of processing soil intermittently, and provided with a sieve across a soil inlet opening at a top end thereof and a soil outlet at a lower end extended downward toward a soil transfer surface of said first conveyer.

3. An automotive soil treating machine as defined in claim 1, wherein said second hopper comprises an additive hopper adapted to hold a predetermined amount of additive soil improving material, and an additive feeder adapted to feed said additive soil improving material from said additive hopper to said first conveyer.

4. An automotive soil treating machine as defined in claim 1, wherein said first conveyer is provided with a sloped soil transfer surface rising gradually upward toward said soil processing mechanism, and said first hopper is located over an upstream end portion of said soil transfer surface and said second hopper is located over a downstream end portion of said soil transfer surface of said first conveyer.

5. An automotive soil treating machine as defined in claim 4, wherein an upstream end of said first conveyer is located at a level lower than said main frame.

6. An automotive soil treating machine is defined in claim 1, wherein said soil processing mechanism comprises an elongated soil processing trough mounted on said main frame to extend in the longitudinal direction of the latter, and a mixing transfer means provided within the soil processing trough and adapted to mix said soil and additive soil improving material uniformly with each other while transferring same toward said the other longitudinal end of said main frame.

7. An automotive soil treating machine as defined in claim 6, wherein said soil processing trough is provided with an inlet opening on an upper side of one longitudinal end portion thereof to receive processing soil and additive soil improving material from said first conveyer, and an outlet opening on a lower side of the other longitudinal end portion and beneath said mixing transfer means to discharge treated soil onto said second conveyer.

8. An automotive soil treating machine as defined in claim 6, wherein said mixing transfer means is constituted by a plural number of paddle mixer assembly units each having a plural number of mixing paddles attached on a rotational shaft in a predetermined pitch, said paddle mixer units being located side by side within said soil processing trough, and rotational shafts of said paddle mixer assembly units being adapted to rotate in an opposite direction relative to an adjacently located paddle assembly unit.

9. An automotive soil treating machine as defined in claim 8, further comprising a rotational drive means for said paddle mixer assembly units, said rotational drive means being provided at a downstream end of said soil processing trough away from said inlet opening.

10. An automotive soil treating machine as defined in claim 8, wherein one of said rotational shafts of said paddle mixer assembly units is driven from a hydraulic motor and rotationally coupled with a rotational shaft or shafts of other rotary paddle assembly unit or units.

11. An automotive soil treating machine as defined in claim 10, wherein said rotational shafts of said paddle mixer assembly units are supported in bearings in front and rear end portions thereof, and said inlet and outlet openings of said soil processing trough are located between said bearings.

12. An automotive soil treating machine as defined in claim 8, wherein said soil processing trough is arranged to have a total length approximately three times as large as an axial pitch of paddles on said rotational shafts of said rotary paddle mixer assembly units.

13. An automotive soil treating machine as defined in claim 12, wherein said paddles are arranged to have a diameter corresponding to ⅓ of said total length of said soil processing trough.

14. An automotive soil treating machine as defined in claim 8, wherein said soil processing trough is provided with a gate member for controlling a soil feed rate therefrom.

15. An automotive soil treating machine as defined in claim 14, wherein said gate member is arranged to cover approximately 20% of a rotational area of said paddle mixer assembly units.

16. An automotive soil treating machine as defined in claim 1, wherein said drive mechanism includes at least an engine and a hydraulic pump, and accommodated within a machine chamber mounted on said support member.

17. An automotive soil treating machine as defined in claim 16, wherein said machine chamber is located to overhang above said second conveyer from a position above said soil processing trough.

18. An automotive soil treating machine as defined in claim 1, wherein said vehicular base carrier is a crawler type vehicle having crawler belts on opposite sides of said main frame.

19. An automotive soil treating machine as defined in claim 18, wherein said first hopper and said soil processing trough are located on opposite sides of a center line connecting centers of said crawler belts, and said second hopper is located approximately on said center line.

20. An automotive soil treating machine, comprising:

a main frame provided on a vehicular base carrier;

a soil hopper provided on said main frame to throw in soil to be treated;

a soil charging conveyer located beneath said soil hopper to receive soil and transfer same onward;

an additive feed unit including an additive hopper and a quantitative feeder and adapted to feed an additive soil improving material onto said conveyer at a controlled feed rate;

a soil processing mechanism mounted on said main frame in association with said soil charging conveyer, and provided with a mixing transfer unit within a soil processing trough, said mixing transfer unit being adapted to mix soil and additive soil improving material uniformly with each other while transferring same substantially horizontally through said soil processing trough;

a soil discharging conveyer provided on said main frame in association with a soil outlet end of said soil processing trough to transfer treated soil onward toward a predetermined discharging point;

a mixing ratio control unit adapted to control a feed rate of said additive soil improving material by said quantitative feeder of said additive feed unit according to a soil feed rate by said soil charging conveyer; and a drive mechanism for said soil processing mechanism, supported on said main frame by means of a support member and at a position over said soil processing mechanism.

21. An automotive soil treating machine as defined in claim 20, wherein said quantitative feeder includes a rotary quantitative container of a predetermined capacity, and said mixing ratio control unit includes a controller adapted to control a mixing ratio by varying rotational speed of said quantitative container for adjusting the feed rate of said additive soil improving material to said charging conveyer according to a soil feed rate to said charging conveyer.

22. An automotive soil treating machine as defined in claim 21, wherein said controller of said mixing ratio control unit includes a soil feed rate detector provided in association with said soil charging conveyer to measure a soil feed rate to said soil processing trough at a point upstream of a position where said additive soil improving material is fed to said charging conveyer by said additive feed unit.

23. An automotive soil treating machine as defined in claim 22, wherein said soil feed rate detector is adapted to measure a soil feed rate on the basis of an amount of treated soil discharged from said soil processing trough.

24. An automotive soil treating machine as defined in claim 23, wherein said soil feed rate detector is adapted to measure a soil feed rate by way of a soil transfer rate by said mixing transfer unit in said soil processing trough.

25. An automotive soil treating machine as defined in claim 24, wherein said mixing transfer unit is constituted by a plural number of paddle mixer assembly units each having a plural number of mixing paddles attached on a rotational shaft in a predetermined pitch, said paddle mixer units being located side by side within said soil processing trough, and rotational shafts of said paddle mixer assembly units being adapted to rotate in an opposite direction relative to an adjacently located paddle assembly unit, and said soil feed rate detector is adapted to detect a soil feed rate by way of rotational speed of said rotational shafts of said mixing transfer unit.

* * * * *